US012408720B2

(12) United States Patent
Reinhall et al.

(10) Patent No.: US 12,408,720 B2
(45) Date of Patent: Sep. 9, 2025

(54) SUPPLEMENTAL IMPACT MITIGATION STRUCTURES FOR A HELMET

(71) Applicant: VICIS IP, LLC, New York, NY (US)

(72) Inventors: Per Reinhall, Seattle, WA (US); Kurt Fischer, New York, NY (US); Cord Santiago, New York, NY (US); Travis E. Glover, Seattle, WA (US); Valerie Carricaburu, Seattle, WA (US); Adam Frank, New York, NY (US); Andre H. P. Stone, New York, NY (US); Jason Neubauer, Seattle, WA (US); Dave Marver, Seattle, WA (US)

(73) Assignee: VICIS IP, LLC, New York, NY (US)

( * ) Notice: Subject to any disclaimer, the term of this patent is extended or adjusted under 35 U.S.C. 154(b) by 721 days.

(21) Appl. No.: 17/556,179

(22) Filed: Dec. 20, 2021

(65) Prior Publication Data

US 2022/0110398 A1 Apr. 14, 2022

Related U.S. Application Data

(63) Continuation-in-part of application No. 16/984,677, filed on Aug. 4, 2020, now Pat. No. 11,930,876, (Continued)

(51) Int. Cl.
*A42B 3/06* (2006.01)

(52) U.S. Cl.
CPC ..... *A42B 3/06* (2013.01)

(58) Field of Classification Search
CPC ..... A42B 3/124; A42B 3/063; A42B 3/128; A42C 2/007
See application file for complete search history.

(56) References Cited

U.S. PATENT DOCUMENTS 4,937,888 A 7/1990 Straus
6,314,586 B1 11/2001 Duguid
(Continued)

FOREIGN PATENT DOCUMENTS

WO WO 2018013996 1/2018
WO 2020037279 A1 2/2020
(Continued)

OTHER PUBLICATIONS asphaltandrubber.com [online], "Gear Review: Shoei NEOTEC II Modular Helmet," Apr. 2, 2018, retrieved on Feb. 4, 2021, retrieved from URL<https://www.asphaltandrubber.com/reviews/shoei-neotec-ii-modular-helmet-review/>, 9 pages.
(Continued)

*Primary Examiner* — Tajash D Patel
(74) *Attorney, Agent, or Firm* — Ingrassia Fisher & Lorenz, LLP

(57) ABSTRACT

A helmet includes an outer shell with an inner and outer surface, a first impact mitigation layer of a first stiffness coupled to the inner surface of the outer shell, a supplemental shell coupled to the outer surface of the outer shell, and a second impact mitigation layer having a second stiffness positioned between the outer surface of the outer shell and an inner surface of the supplemental shell. The supplemental shell can flex from a first position to a second position upon impact to the supplemental shell. A difference between the first stiffness and second stiffness allows the first and second impact mitigation layers to absorb impacts of different impact force. The supplemental protection component can be optimized for protection against impacts experienced by a particular position, including the location on the helmet, shape, materials, and impact mitigation structures.

20 Claims, 22 Drawing Sheets

Related U.S. Application Data which is a continuation of application No. PCT/US2019/016654, filed on Feb. 5, 2019.

(60) Provisional application No. 63/128,337, filed on Dec. 21, 2020, provisional application No. 62/626,580, filed on Feb. 5, 2018.

(56) References Cited

U.S. PATENT DOCUMENTS

| | | | | |
|---|---|---|---|---|
| 6,871,525 | B2 | 3/2005 | Withnall et al. | |
| D592,808 | S | 5/2009 | Murphy et al. | |
| D598,609 | S | 8/2009 | Durocher | |
| 7,743,640 | B2 | 6/2010 | Lampe et al. | |
| D628,347 | S | 11/2010 | Chen | |
| D670,447 | S | 11/2012 | Emrich et al. | |
| D672,920 | S | 12/2012 | Durocher et al. | |
| D677,006 | S | 2/2013 | Pfanner et al. | |
| 8,418,270 | B2 | 4/2013 | Desjardins et al. | |
| 8,528,118 | B2 | 9/2013 | Ide et al. | |
| 8,756,719 | B2 | 6/2014 | Veazie | |
| D752,822 | S | 3/2016 | Bologna | |
| 9,314,061 | B2 | 4/2016 | Hanson et al. | |
| D778,504 | S | 2/2017 | Collette et al. | |
| D787,748 | S | 5/2017 | Bologna | |
| 9,788,591 | B2 | 10/2017 | Ide et al. | |
| D804,729 | S | 12/2017 | Bouchard-Fortin et al. | |
| 9,907,346 | B2 | 3/2018 | Hanson et al. | |
| 10,136,692 | B2 | 11/2018 | Ide et al. | |
| D836,253 | S | 12/2018 | Erb et al. | |
| 10,159,296 | B2 | 12/2018 | Pietrzak et al. | |
| D844,255 | S | 3/2019 | Bologna | |
| 10,271,605 | B2 | 4/2019 | Withnall et al. | |
| 10,362,829 | B2 | 7/2019 | Lowe | |
| D856,600 | S | 8/2019 | Withnall et al. | |
| D860,547 | S | 9/2019 | Daoust et al. | |
| 10,506,841 | B2 | 12/2019 | Bologna et al. | |
| 10,537,148 | B2 | 1/2020 | Hanson et al. | |
| 10,561,193 | B2 | 2/2020 | Withnall et al. | |
| 10,780,338 | B1 | 9/2020 | Bologna et al. | |
| 10,856,600 | B2 | 12/2020 | Ide et al. | |
| 10,932,514 | B2 | 3/2021 | Ide et al. | |
| 10,948,898 | B1 | 3/2021 | Pietrzak et al. | |
| D916,385 | S | 4/2021 | Withnall et al. | |
| 11,064,752 | B2 | 7/2021 | Hanson et al. | |
| D927,084 | S | 8/2021 | Bologna et al. | |
| 11,166,511 | B2 | 11/2021 | Infusing et al. | |
| 11,167,198 | B2 | 11/2021 | Bologna et al. | |
| 11,213,736 | B2 | 1/2022 | Bologna et al. | |
| 11,229,254 | B1 * | 1/2022 | Matteucci | A42B 3/063 |
| 11,291,263 | B2 | 4/2022 | Lowe | |
| 11,311,067 | B2 | 4/2022 | Bologna et al. | |
| 11,399,589 | B2 | 8/2022 | Bologna et al. | |
| 11,419,383 | B2 | 8/2022 | Pietrzak et al. | |
| 11,503,872 | B2 | 11/2022 | Bologna et al. | |
| 11,638,457 | B2 | 5/2023 | Lowe | |
| 11,712,615 | B2 | 8/2023 | Bologna et al. | |
| 2009/0307827 | A1 | 12/2009 | Aspray | |
| 2012/0017358 | A1 | 1/2012 | Princip et al. | |
| 2012/0317705 | A1 | 12/2012 | Lindsay | |
| 2013/0298316 | A1 | 11/2013 | Jacob | |
| 2016/0209307 | A1 | 7/2016 | Chan | |
| 2016/0255900 | A1 | 9/2016 | Browd et al. | |
| 2016/0278470 | A1 | 9/2016 | Posner et al. | |
| 2017/0303622 | A1 | 10/2017 | Stone et al. | |
| 2017/0303623 | A1 | 10/2017 | Sicking et al. | |
| 2018/0092420 | A1 | 4/2018 | Lewis | |
| 2018/0184745 | A1 * | 7/2018 | Stone | A42B 3/065 |
| 2018/0249778 | A1 * | 9/2018 | Brandt | B32B 9/047 |
| 2018/0343953 | A1 | 12/2018 | Erb et al. | |
| 2020/0085130 | A1 * | 3/2020 | Beckman | A42B 3/063 |
| 2020/0188733 | A1 | 6/2020 | Beckwith | |
| 2021/0000209 | A1 | 1/2021 | Neubauer et al. | |
| 2021/0007432 | A1 | 1/2021 | Santiago et al. | |
| 2023/0019358 | A1 * | 1/2023 | Erb | A42B 3/122 |
| 2023/0354944 | A1 | 11/2023 | Petre | |
| 2024/0041150 | A1 * | 2/2024 | Torbati | A42B 3/125 |
| 2024/0180285 | A1 | 6/2024 | Pietrzak | |

FOREIGN PATENT DOCUMENTS

| | | | | |
|---|---|---|---|---|
| WO | 2022058851 | A1 | 3/2022 | |
| WO | 2024081303 | A1 | 4/2024 | |
| WO | WO-2024092307 | A1 * | 5/2024 | A41D 13/0153 |

OTHER PUBLICATIONS grainger.com [online], "Partial Crown, Headgear, Pinlock Faceshield Assembly", upon information and belief, available no later than Feb. 4, 2021, retrieved on Feb. 4, 2021, retrieved from URL<https://www.grainger.com/product/HONEYWELL-FIBRE-METAL-Headgear-Gray-15W971?searchQuery=15w971&searchBar=true>, 1 page.

International Preliminary Report on Patentability in Appln. No. PCT/US2019/016654, dated Aug. 20, 2020, 8 pages.

International Search Report and Written Opinion in Appln. No. PCT/US2019/016654, dated Apr. 12, 2019, 8 pages.

NFL.com [online], "Video Review Webinar," upon information and belief, available no later than Apr. 19, 2021, retrieved on Feb. 17, 2022, retrieved from URL<https://www.nfl.com/photos/video-review-webinar#1018d96b-56a4-4996-a531-232b7043bd0d>, 45 pages.

nflcommunications.com [online], "New Video Review Aims to Help Improve Designs for Protective Equipment," Nov. 19, 2017, retrieved on Feb. 18, 2022, retrieved from URL<https://nflcommunications.com/Documents/11.9.17%20Video%20Review%20Webinar%20News%20Release%20v2.pdf>, 3 pages.

on24.com [online], "NFL Video Review Webinar," upon information and belief, available no later than Nov. 9, 2017, retrieved on Jan. 31, 2022, retrieved from URL<https://event.on24.com/eventRegistration/EventLobbyServlet?target=reg20.jsp&referrer-&eventid=1530677&sessionid=1&key=6F9DE2082FAA88BD475651BE77CA1B6A&regTag=&sourcepage=register>www.playsmartplaysafe.com, 1 page.

teammotorcycle.com [online], "Icon Variant Double Stack Helmet Visor," Oct. 28, 2020, retrieved on Feb. 4, 2021, retrieved from URL<https://www.teammotorcycle.com/icon-variant-double-stack-helmet-visor>, 2 pages.

youtube.com [online], "Fox Rampage Pro Carbon | An Icon Redefined," Mar. 28, 2019, retrieved on Feb. 4, 2021, retrieved from URL<https://www.youtube.com/watch?v=wFBY-PFM4_k&feature=emb_logo>, 4 pages.

* cited by examiner

SUPPLEMENTAL IMPACT MITIGATION STRUCTURES FOR A HELMET

CROSS-REFERENCE TO RELATED APPLICATIONS

This application claims the benefit under 35 U.S.C. § 119(e) of U.S. Provisional Application No. 63/128,337, filed Dec. 21, 2020, and is a continuation-in-part of U.S. patent application Ser. No. 16/984,677, filed on Aug. 4, 2020, which application is a continuation of International Application No. PCT/US2019/16654, filed Feb. 5, 2019, which application claims the benefit under 35 U.S.C. § 119(e) of U.S. Provisional Application No. 62/626,580, filed Feb. 5, 2018. The disclosure of each of the foregoing applications are incorporated herein by reference in their entirety for all purposes.

TECHNICAL FIELD

This specification generally relates to technology for mitigating impact on various regions of a helmet.

BACKGROUND

Many modern organized sports employ helmets that are designed to provide players of those sports with significant head protection from impacts. Generally, there is a desire to provide adequate protection from traumatic brain injuries (TBI). Concussions and/or other repetitive brain injuries can lead to long-term brain damage and can potentially end a player's career early. Out of concern for player safety, helmets have evolved to include safety mechanisms to reduce the rate of occurrence of such injuries. This is especially true in American football, where the essential character of the athletic contest involves repeated player contacts, impacts and tackling. However, most current sport helmet designs fail to protect against some of the most dangerous impacts that occur within a game.

Recently, there has been increased public attention on TBI in American football, and the long-term effects of TBI on players. Such public attention has compelled large sports organizations and other researchers to conduct comprehensive review and analysis of "impact data" to understand how particular types and degrees of impacts can cause concussions or other player injuries during games. In 2017, NFL publicly released a data set compiled from its own comprehensive review revealing differences in the source, activity type, play type, position, location, severity, and frequency of impacts each player position experienced on the field that led to a concussion diagnosis, the disclosure of which is herein incorporated by reference in its entirety (Video Review Webinar, Center for Applied Biomechanics at Univ. of Virginia and the NFL Engineering Committee, www-.playsmartplaysafe.com).

The results of the NFL study and the continued risk of impact leading to TBI in football and other sports reveal that there is a need for optimization of helmet structure designs to mitigate impact forces.

SUMMARY

This document generally describes technology for optimizing a protective helmet or other item of protective clothing with one or more enhanced principal impact zones and/or impact elements that incorporate protective features designed to mitigate risk associated with impact. The supplemental protection components described herein can be utilized to enhance or alter protective helmets and other protective clothing, including retrofitting an existing commercially available helmet or modifying existing commercially available helmet designs to incorporate protective elements and/or redesigning new helmets to provide supplemental protection to a wearer. The supplemental protection components can be particularized to a specific player-position and/or the individual behavior of a specific player, and can be designed based on analysis of position-specific impact risk. By incorporating additional protection where it is most needed for each player position (a position-specific helmet), risk of impact-based injury including TBI can be reduced.

Conventionally, a common helmet design including some protective padding is designed to be used for all players, regardless of an assigned position of the player and particular risks associated with the position. However, individual players and/or player positions in a given athletic competition (including, but not limited to American football) may experience particular sources of impact, angles of impact, location of impact, severity of impact or frequency of impact based on their assigned or usual position of play, player activity type, or play type. Analysis of the common impact characteristics common to a position can enable enhanced protection specific to the position and the particular associated risks relative to a conventional helmet designed for all positions.

The design and manufacture of a helmet having position-specific supplemental protection components or retrofitting of a commercially available (CA) helmet with position-specific protections may require a method for the initial ranking of particular factors and risks of a position to determine the most relevant supplemental impact protective elements to be incorporated into the helmet design. A position-specific supplemental protection component is an addition or extension of a protective helmet or pad that is designed and located so as to protect against the types of impacts experienced by a player of a sport when playing a particular position, for example, playing the position of linebacker or quarterback in football.

A conventional helmet may be tuned to absorb moderate velocity impacts, but not have enough offset for low velocity impacts or enough stiffness for absorption of high velocity impacts. Any helmet has an offset distance between the outer surface and the wearer's head. The offset distance can vary around the helmet surface. In an impact, if all the helmet offset in a particular location is fully compressed (i.e., compressed until it cannot be compressed anymore) and the impact is not completely absorbed, there is a spike in the velocities experienced by the wearer's head (this is known as "bottoming out"). In an impact, if the offset is compressed only a small amount (e.g., 10-20% of the available offset), the offset is not being efficiently utilized and velocities experienced by the wearer's head are higher than what may be achieved with the given offset. Ideally, in an impact, if all of the offset is compressed, but not to the point of "bottoming out," the offset is used to the highest efficiency to protect the head of the wearer. During use of a helmet, there may be known "high" and "low" velocities that the helmet experiences, but the conventional helmet cannot mitigate both velocities to the highest efficiency. Conventional helmets typically mitigate the "high" velocity using the offset most efficiently, and the low velocity is mitigated using only a portion of the offset. Additional components that efficiently use offset to mitigate "low" velocity impacts not efficiently absorbed by the helmet can be added, with the additional component having materials of a stiffness determined to best absorb the "low" velocity impacts without compromising the original helmet's mitigation of the "high" velocities. When an additional or supplemental component is added to a helmet, the supplemental component has an additional offset that can be efficiently utilized to absorb the particular impact. For example, upon impact to the supplemental component, the material of the component is compressed nearly the full extent of the offset, absorbing the impact without passing on the velocities and forces to the wearer's head. The helmet can still serve to absorb impacts to portions of the helmet not covered by the supplemental component, and impacts having other associated velocities. The addition of a supplemental component tuned to absorb these types of impacts not typically absorbed by a helmet can improve safety for players wearing the helmet.

Particular positions may have different needs with regard to impact mitigation and types or locations of common or average impacts that can be taken into account in the design process. For example, a linebacker may predominantly experience low-velocity impacts to a front portion of the helmet, while a quarterback may predominantly experience higher-velocity impacts to a back portion of the helmet as a result of falling backwards to the ground upon being tackled from the front. Each of the linebacker and the quarterback can benefit from the addition of helmet components that are located on a portion of the helmet so as to protect against the particular impacts experienced. The quarterback may be best protected by the addition of high-velocity impact-cushioning components at a back of the helmet which prevent injury when the quarterback impacts the ground. The linebacker, on the other hand, may be best protected by the addition of impact-cushioning components to the front part of the helmet where the majority of the impacts are experienced, the impact-cushioning component designed to protect against the low-velocity impacts linebackers experience when grappling on the field. Further, various impact mitigation materials and structures can be designed or incorporated to tune the supplemental protection components to absorb particular types of impacts for a particular positions, while still allowing for the general impact protection of the underlying helmet.

In an aspect, a helmet includes an outer shell, a first impact mitigation layer, a supplemental shell, and a second impact mitigation layer. The outer shell includes an outer surface and an inner surface. The first impact mitigation layer is coupled to the inner surface of the outer shell, and has a first stiffness. The supplemental shell is coupled to the outer surface of the outer shell. The supplemental shell covers a portion of the outer surface of the outer shell and is configured to flex from a first position to a second position upon impact to the supplemental shell. The second impact mitigation layer is positioned between the outer surface of the outer shell and an inner surface of the supplemental shell. The second impact mitigation layer has a second stiffness different from the first stiffness.

In some implementations, upon impact to the supplemental shell, the second impact mitigation layer provides a first impact absorption response and the first impact mitigation layer provides a second impact absorption response for a residual impact force remaining after the first impact absorption response.

In some implementations, the second stiffness is less than the first stiffness and the supplemental shell is coupled to a forehead portion of the outer shell. In some implementations, the second impact mitigation layer fully compresses upon an impact velocity of about 3 m/s to the supplemental shell. In some implementations, the first stiffness is about 20% stiffer than the second stiffness.

In other implementations, the second stiffness is greater than the first stiffness and the supplemental shell is coupled to a rear portion of the outer shell. In some implementations, the second impact mitigation layer fully compresses upon an impact velocity of 13-14 m/s to the supplemental shell. In some implementations, the second stiffness is about 20% stiffer than the second stiffness.

In some implementations, the supplemental shell is formed from a first flexible material. In some implementations, the first flexible material of the supplemental shell is locally deformable. In some implementations, the outer shell is formed from a second material. In some implementations, the second material is a rigid material, for example a polycarbonate material. In some implementations, the second material is a second flexible material. In some implementations, the first flexible material and the second flexible material are a same material. In some implementations, the first flexible material and the second flexible material are non-porous materials. In some implementations, the first flexible material and the second flexible material are painted.

In some implementations, the second impact mitigation layer includes multiple mitigation structures formed as one of flexible domed structures, flexible polygonal structures, flexible vertical structures, foam structures, undulating structures, laterally supported filament structures, auxetic structures, or 3D printed lattice structures.

In some implementations, the second impact mitigation layer is coupled to the inner surface of the supplemental shell by an adhesive. In some implementations, the supplemental shell is removably coupled to the outer surface of the outer shell. In some implementations, the supplemental shell is coupled to the outer surface of the outer shell by at least one fastener. In some implementations, at least one edge of the supplemental shell is flush against the outer surface of the outer shell when the supplemental shell is coupled to the outer surface of the outer shell.

In an aspect, a supplemental impact absorbing element includes a flexible outer shell and multiple impact mitigation structures coupled to the flexible outer shell. The flexible outer shell is shaped and sized so as to fully enclose the multiple impact mitigation structures when the flexible outer shell is coupled flush to an outer surface of a helmet. The flexible outer shell and the multiple impact mitigation structures are locally deformable in response to an impact on the flexible outer shell.

In some implementations, upon impact to the flexible outer shell, the multiple impact mitigation structures provide a first impact absorption response. In some implementations, a stiffness of the multiple impact mitigation structures is tuned to a position-specific average impact speed. In some implementations, the multiple impact mitigation structures fully compress upon an impact velocity of about 3 m/s to the flexible outer shell. In some implementations, the multiple impact mitigation structures fully compress upon an impact velocity of 13-14 m/s to the flexible outer shell.

In some implementations, the flexible outer shell is formed from a flexible material. In some implementations, the flexible material is a non-porous material. In some implementations, the flexible material is painted.

In some implementations, the multiple impact mitigation structures are formed as one of flexible domed structures, flexible polygonal structures, flexible vertical structures, foam structures, undulating structures, laterally supported filament structures, auxetic structures, or 3D printed lattice structures. In some implementations, the multiple impact mitigation structures are coupled to an inner surface of the flexible outer shell by an adhesive.

In an aspect, a method of manufacturing a supplemental protection component for use with a helmet for a wearer playing a particular position includes identifying a portion of the helmet where helmet wearers playing a particular position sustain a threshold number of impacts. The method also includes determining an average impact force of impacts sustained at the identified portion of the helmet and selecting an impact mitigation material capable of locally deforming in response to an impact having the average impact force so as to absorb the average impact force. The method further includes producing a supplemental protection component shaped and sized to be coupled to the identified portion of the helmet, the supplemental protection component including a flexible shell and at least one impact mitigation structure within the flexible shell. The at least one impact mitigation structure is formed from the selected impact mitigation material.

In some implementations, selecting the impact mitigation material further includes determining a material stiffness tuned to the average impact force. In some implementations, selecting the impact mitigation material includes engineering an impact mitigation structure having the material stiffness. In some implementations, the average impact force has an impact velocity of between 3 m/s and 10 m/s.

In some implementations, the method further includes selecting a height of the supplemental protection component from an outer surface of the helmet based on the average impact force and the selected impact mitigation material. The selected height can be such that the average impact force locally deforms the supplemental protection component and selected impact mitigation material without causing contact between the flexible shell of the supplemental protection component and an outer surface of the helmet.

In some implementations, producing the supplemental protection component further includes injection molding the at least one impact mitigation structure. In some implementations, producing the supplemental protection component further includes adhering the at least one impact mitigation structure within the flexible shell.

The details of one or more implementations are set forth in the accompanying drawings and the description below. Other features and advantages will be apparent from the description and drawings, and from the claims.

DETAILED DESCRIPTION

Described below are various implementations of systems and methods for incorporating a supplemental protection component into a helmet design to provide protection against particular impacts common to a position. The systems and techniques described herein provide additional impact mitigation that can be incorporated into a new helmet design or removably added to an existing helmet to provide supplemental protection against particular types or forces of impacts commonly experienced by players in a particular position. Though the figures and descriptions throughout are related to football helmets, the systems and methods described herein are not limited to use in providing impact protection and mitigation for football players, and are also applicable to players of other sports, including hockey, lacrosse, rugby, wrestling, baseball, cricket, and other activities requiring use of protective helmets or protective pads, such as construction or military activities. Additionally, though the supplemental protection components described herein are related to components incorporated in or added to helmets for protection of impacts to the head, the described systems and methods are also applicable to other protective articles, such as clothing or padding worn by players to protect against impact.

Athletes who play a particular position in a sport can be regularly subject to similar impacts, which a conventional helmet may not adequately protect against. Different player positions in football, such as quarterback, running back, or linebacker, can be subject to different types of impacts and different forces or velocities of impact. For example, some positions (e.g., linebacker in football) may regularly experience helmet-on-helmet close-range impacts to the front and top portion of the helmet, while other positions (e.g., quarterback in football) most commonly experience an impact to a back of the helmet from hitting the ground after a front tackle. These impacts experienced by players playing certain positions can have velocities which are higher or lower than the impacts that are efficiently mitigated by the offset of a conventional helmet. To better protect athletes from injury due to common impacts for their positions, helmets or supplemental helmet components can be designed to protect against the particular types and velocities of impacts experienced by players in particular positions. The supplemental protection components of the helmets can add protections beyond the usual general protection of a helmet that are optimized for the particular positions and associated impact risks. By selecting the region of the helmet to be protected and the materials and impact mitigation structures forming the offset that are tuned to absorb the typical or common impact forces and velocities, athletes can be better protected against injury including concussion and TBI.

Figure 1A:
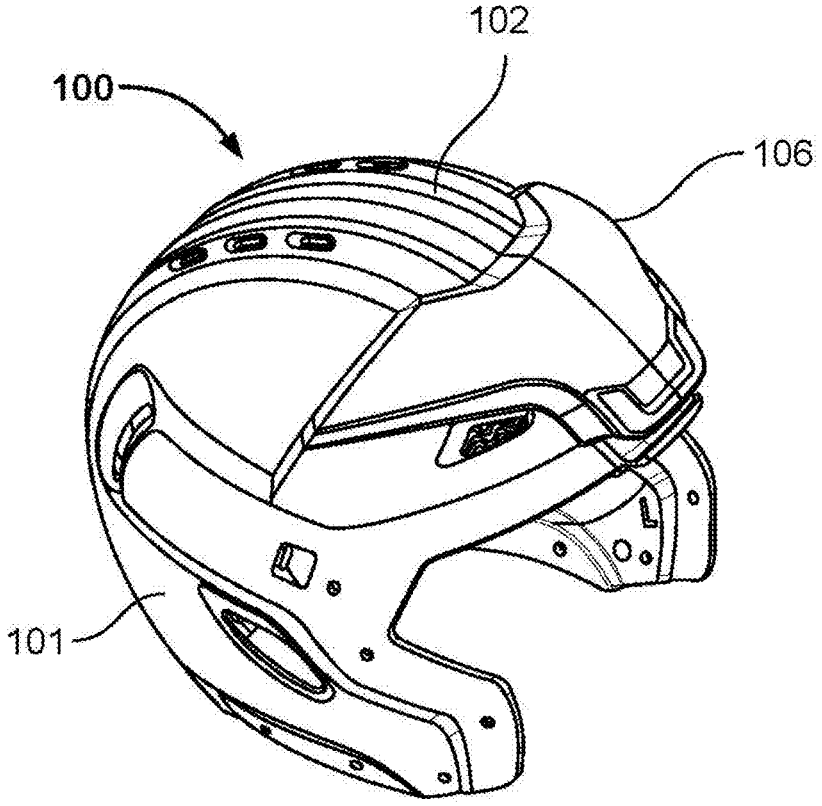
FIG. 1A shows a side perspective view of an example helmet including a supplemental protection component.
Figure 1B:
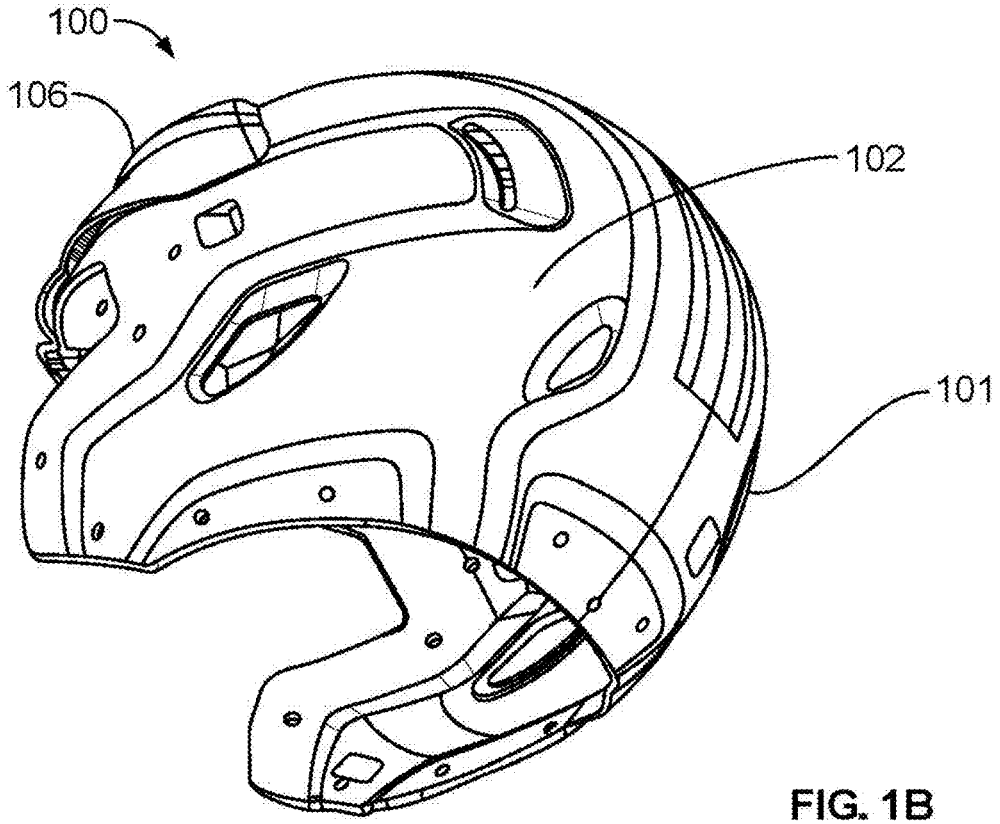
FIG. 1B shows a back perspective view of an example helmet including a supplemental protection component.

FIGS. 1A and 1B show an example helmet assembly 100 including a helmet 101 and a supplemental protection component 106 coupled to an outer shell 102 of the helmet 101 (the outer shell 102, may also be referred to as an outer layer herein). FIG. 1A shows a side perspective view of the helmet 100 having the supplemental protection component 106 coupled to the front region of the helmet, and FIG. 1B shows a back perspective view of the helmet 100.

The supplemental protection component 106 can be constructed as a single supplemental impact protective element or as an assembly of supplemental impact protection elements. As illustrated in FIGS. 1A and 1B, the supplemental protection component 106 can be coupled to a frontal region of the helmet, but can also be coupled to other areas or regions of the helmet depending on the type of impact the component is designed to protect against. For example, the supplemental protection component 106 can be coupled to one or more specific regions of the helmet 100. The regions may comprise a frontal region (or front), an occipital region (or lower-back), a mid-back region, a parietal region (or midline), and a temporal region (right and/or left sides), the orbit region, the mandible (front, right and/or left side) region, the maxilla region, the nasal region, zygomatic region, the ethmoid region, the lacrimal region, the sphenoid region and/or any combination(s) thereof.

Figure 2A:
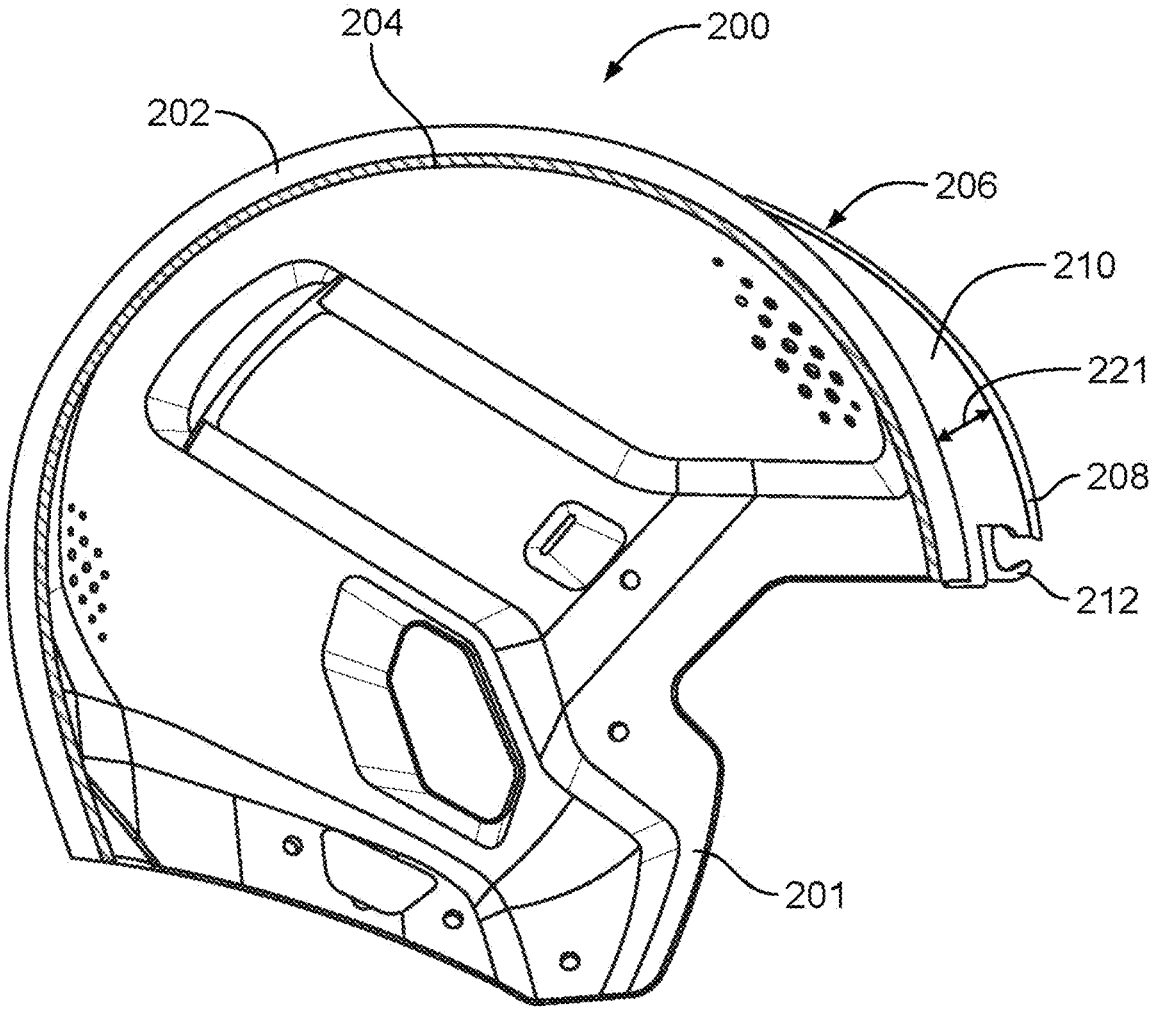
FIG. 2A shows a cross-sectional view of an example helmet including a supplemental protection component.
Figure 2B:
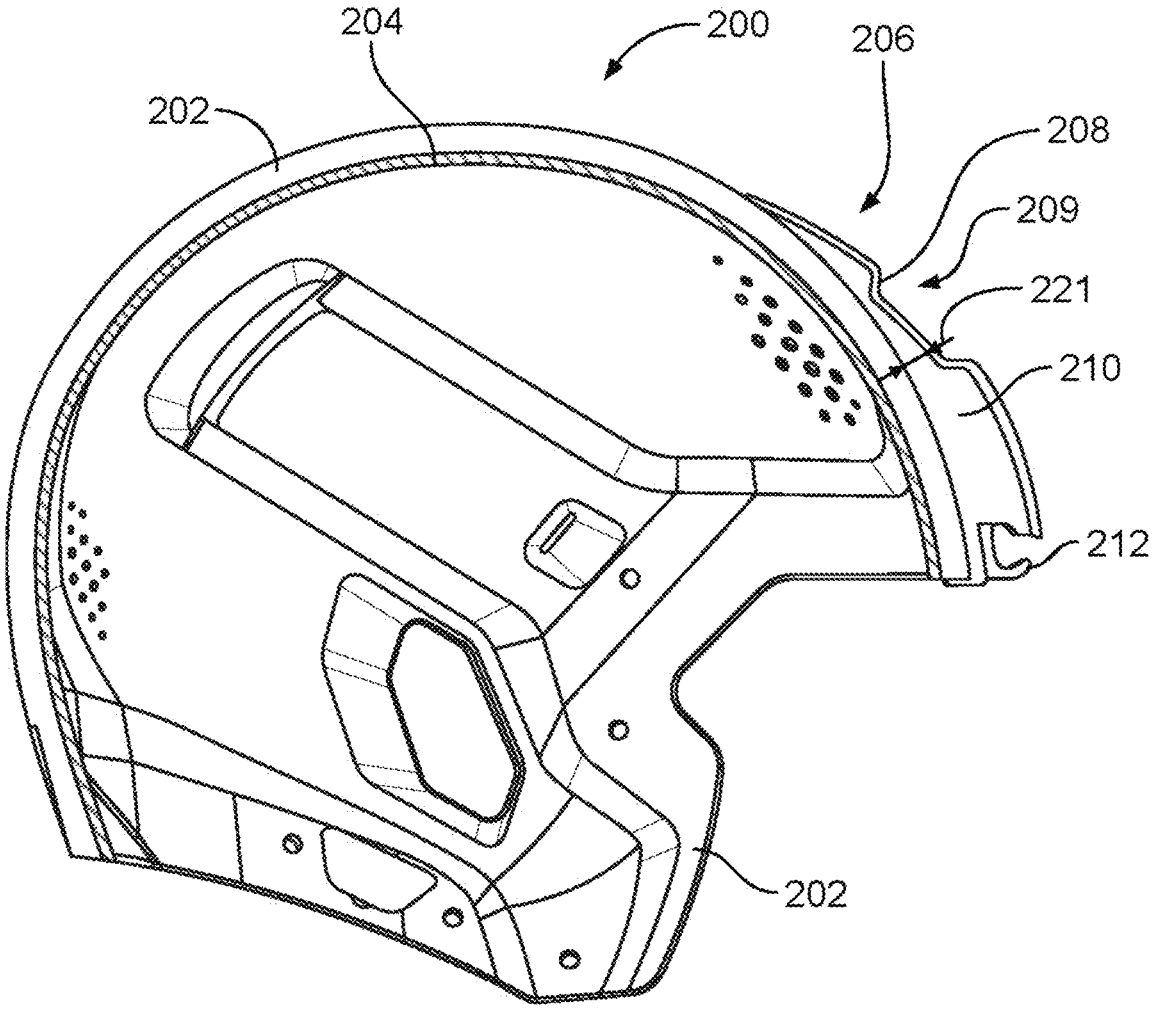
FIG. 2B shows a cross-sectional view of the example helmet including a supplemental protection component of FIG. 2A following impact on the helmet.

FIGS. 2A and 2B illustrate a cross-sectional view of a helmet assembly 200 including a helmet 201 and a supplemental protection component 206. The helmet 201 includes an outer shell 202 and an impact mitigation layer 204 disposed within the outer shell 202 and a supplemental protection component 206 disposed on an outer surface of the outer shell 202. The supplemental protection component 206 includes a supplemental shell 208 and a second impact mitigation layer 210 positioned between the supplemental shell 208 and the outer shell 202.

The outer shell 202 includes an outer surface or external surface and an inner surface or an internal surface. The impact mitigation layer 204 is coupled to the inner surface of the outer shell 202. The impact mitigation layer 204 includes one or more impact mitigation structures. In some implementations, the helmet 201 may further include an inner layer (not shown), the inner layer having an outer surface and an inner surface, and the outer shell 202 can be spaced apart from the inner layer to define a space in which the impact mitigation layer 204 is disposed. This is part of the offset of the helmet in the particular region of the helmet, or the distance between the outer surface experiencing impact and the player's head. The impact mitigation layer 204 can be permanently coupled to the inner surface of the outer shell, or can be removably coupled to the inner surface of the outer shell. In some implementations, the impact mitigation layer 204 is formed from a foam material, including a slow-response foam, an open-cell foam, a closed cell foam, and/or a urethane foam. In some implementations, the impact mitigation layer 204 is formed from auxetic materials. In some implementations, the impact mitigation layer 204 includes multiple impact mitigation structures, such as columnar structures, domed structures, or polygonal buckling structures. In some implementations, the impact mitigation layer 204 includes multiple filaments. In some implementations, the impact mitigation layer 204 includes multiple mitigation structures formed as flexible domed structures, flexible polygonal structures, flexible vertical structures, foam structures, undulating structures, laterally supported filament structures, auxetic structures, or 3D printed lattice structures. In some implementations, the impact mitigation layer 204 is formed as a single layer. In other implementations, the impact mitigation layer 204 is formed as multiple cushions or pads, which may collectively form a single layer or which may be stacked to form multiple layers that are fixed or removably coupled to the inner surface of the outer shell 202 of the helmet 201.

The second impact mitigation layer 210 of the supplemental protection component 206 is positioned between the supplemental shell 208 and the outer shell 202. In some implementations, the second impact mitigation layer 210 is positioned between an inner surface of the supplemental shell 208 and an outer surface of the outer shell 202. The supplemental protection component 206 can be permanently or removably attached to the outer shell 202 of the helmet 201. The supplemental shell 208 is preferably flush with the outer shell 202 at the edges of the supplemental shell 208, such that the second impact mitigation layer 210 is entirely surrounded by the supplemental shell 208 and the outer shell 202, and is not visible when the supplemental protection component 206 is installed in the helmet assembly 200.

In some implementations, the supplemental shell 208 is formed from a flexible material, which can move from a first state or shape to a second state or shape in response to an impact. The flexible material may comprise a flexible polymer or a rigid polymer. In some implementations, the flexible polymer is sufficiently flexible to allow local deformation of the supplemental shell 208 during an impact, and to allow the return to its original configuration after impact. The flexible polymer may include elastic or viscoelastic properties. The supplemental shell 208 may be formed from a same flexible material as the outer shell 202 of the helmet 201, or from a different material. The material of the supplemental shell 208 may be less rigid or more rigid than the material of the outer shell 202 of the helmet 201. In some implementations, the outer shell 202 of the helmet 201 is formed from a rigid material. For example, the outer shell 202 can be formed from a polycarbonate material. In such implementations, the supplemental shell 208 may be formed from a more flexible material than the outer shell 202, in some cases significantly more flexible and capable of local deformation.

The supplemental shell 208 may be formed as a dome that extends from the outer surface of the outer shell 202. In some implementations, the dome structure of the supplemental shell 208 comprises a shape, the shape being a hemispherical dome structure, the hemispherical structure resembling a hollow half-sphere. In some implementations, the supplemental protection component 206 includes portions which flex differently than adjacent portions of the supplemental protection component 206 due to shape, material, or dimensions such as a depth. In some implementations, the supplemental protection component 206 has a dome shape such as a beehive dome, a braced dome, a compound dome, a cross-arched dome, and ellipsoidal dome, a geodesic dome, an onion dome, an oval dome, a paraboloid dome, a sail dome or sail vault domes, a saucer dome, an umbrella dome, and/or any combination thereof.

In some implementations, the supplemental protection component 206 structure comprises a dome shape, the shape being an arched structure. The supplemental protection component 206 may further include a first end and a second end, the first end comprising a first base, and the second end comprising a second base, such that the supplemental protection component 206 behaves similar to a traditional dome structure where the dome structure spans certain distances without requiring intermediate columns, are self-supporting, and are stabilized by the force of gravity acting on their weight to held them in compression. Such domed structures produce downward and outward thrust, the downward thrust may be transferred to the bases and/or the outward thrust should be resisted to prevent the dome from collapsing. The first end and/or second may be integrally formed with to the supplemental protection component 206. Alternatively, the first end may be affixed as a separate component to the supplemental protection component 206. The first end may be disposed or positioned at the bottom edge and/or adjacent to the bottom edge of the supplemental protection component 206 and the second end disposed or positioned at the top edge and/or adjacent to the top edge of the supplemental protection component 206. Alternatively, the first end may be disposed or positioned at the top edge and/or adjacent to the top edge of the supplemental protection component 206, and the second end disposed or positioned at the bottom edge and/or adjacent to the bottom edge of the supplemental protection component 206. In some implementations, the first or second end may extend beyond the bottom edge or the top edge of the supplemental impact protection element.

As will be described below in FIGS. 17A-E, the supplemental protection component 206 can include cut-outs or cantilevered shapes in order to provide alternative or additional impact mitigation. In some implementations, the supplemental protection component 206 includes a collapsible member (not shown) formed in the supplemental shell 208 including an empty gap or spacing that surrounds a portion of the collapsible member to define its boundaries. The empty gap or spacing may comprise removed material to allow the collapsible member to flex differently than adjacent portions of the supplemental protection component 206.

In FIGS. 2A and 2B, the supplemental protection component 206 is positioned on the frontal region of the helmet 201 over the forehead region of a wearer. In some implementations, the supplemental protection component 206 is positioned elsewhere on the helmet 201, e.g., based on the type of impact it is designed to protect against. The supplemental protection component 206 includes a supplemental shell 208 and a second impact mitigation layer 210.

At least a portion of the supplemental protection component 206 may be coupled to one or more specific regions of the helmet 201. Alternatively, at least a portion of the supplemental protection component 206 may be coupled to one or more specific regions or position-specific regions of the external surface of the outer shell 202. The regions may comprise a frontal region (or front), an occipital region (or lower-back), a mid-back region, a parietal region (or midline), and a temporal region (right and/or left sides), the orbit region, the mandible (front, right and/or left side) region, the maxilla region, the nasal region, zygomatic region, the ethmoid region, the lacrimal region, the sphenoid region and/or any combination(s) thereof.

In some implementations, the second impact mitigation layer 210 is formed from a foam material, including a slow-response foam, an open-cell foam, a closed cell foam, and/or a urethane foam. In some implementations, the second impact mitigation layer 210 is formed from an auxetic materials. In some implementations, the second impact mitigation layer 210 is formed from multiple impact mitigation structures, such as columnar structures, domed structures, or polygonal buckling structures. In some implementations, the second impact mitigation layer 210 includes multiple filaments. In some implementations, the second impact mitigation layer 210 includes multiple mitigation structures formed as flexible domed structures, flexible polygonal structures, flexible vertical structures, foam structures, undulating structures, laterally supported filament structures, auxetic structures, or 3D printed lattice structures. In some implementations, the second impact mitigation layer 210 is formed from multiple engineered structures designed based on the particular impact characteristics of a playing position. In such implementations, the structures forming the second impact mitigation layer 210 may be designed or 'tuned' to have a material stiffness and size or thickness adequate to absorb an impact force common to a particular playing position, for example by fully compressing under the common impact force. In some implementation the average impact force has an impact velocity of between 3 m/s and 10 m/s, and up to 15 m/s. The height or thickness 221 of the second impact mitigation layer 210 is selected so as to locally deform under the common or average impact force without allowing the supplemental shell 208 to contact the outer shell 202 of the helmet 201. If the second impact mitigation layer 210 and supplemental shell 208 were to deform to contact the outer shell 202 of the helmet 201, the impact force would be passed on to the wearer rather than absorbed by the supplemental protection component 206. In some implementations, the second impact mitigation layer 210 includes multiple vertical internal walls, which provide an initial stiffness and a resistance to forces under a specific minimum force. The modulus of the material chosen and used as the second impact mitigation layer, and the thickness of the second mitigation layer, is chosen so as to absorb impacts of the speed and location on the helmet commonly experienced by a player in a certain position. The most common impact forces and types can be determined for example by the methods described below in the description of FIG. 18. In some implementations, the impact mitigation layer 204 and the second impact mitigation layer 210 are formed from a same material. In other implementations, the impact mitigation layer 204 and the second impact mitigation layer 210 are formed from different materials. The second impact mitigation layer 210 can have a thickness 221 measured from the outer shell 202 of the helmet 201 to the inner surface of the supplemental shell 208 which varies across the second impact mitigation layer 210.

The supplemental protection component 206, including the supplemental shell 208 and second impact mitigation layer 210, is designed to flex or locally deform upon impact to the supplemental protection component 206. Each of the impact mitigation layer 204 and the second impact mitigation layer 210 can have an associated stiffness which is the same or different. The stiffness of the impact mitigation layer 204 and the second impact mitigation layer 210 influence the response of the helmet 201 and supplemental protection component 206 to impacts of different forces. As described above, the helmet 201 may have an offset (distance from the outer surface to the surface of the wearer's head) which deforms and compresses to efficiently mitigate impacts of certain velocities (e.g., high velocity impacts common to all or a majority of player positions of a sport). The supplemental protection component 206 extends from the surface of the outer shell 202 and has an additional offset of thickness 221 which is designed to compress to efficiently mitigate impacts of a differently velocity (e.g., low velocity impacts common to a particular position). For example, the second impact mitigation layer 210 can provide a first impact absorption response and the impact mitigation layer 204 can provide a second impact absorption response for residual impact force remaining after the first impact absorption response, based on the stiffness, or other properties, of the materials. In some implementations, the material of the impact mitigation layer 204 has a greater stiffness than the material of the second impact mitigation layer 210. For example, the stiffness of the impact mitigation layer 204 may be 5%, 10%, 20%, 25%, 30%, or 50% stiffer than the second impact mitigation layer 210. In some implementations, the material of the impact mitigation layer 204 has a lesser stiffness than the material of the second impact mitigation layer 210. For example, the stiffness of the impact mitigation layer 204 may be 5%, 10%, 20%, 25%, 30%, or 50% less stiff than the second impact mitigation layer 210.

As illustrated in FIG. 2B, an impact 209 upon the supplemental protection component 206 can locally deform both the supplemental shell 208 and the underlying second impact mitigation layer 210 in the region of the impact. As a result, the thickness 221 of the second impact mitigation layer 210 also changes during or after the impact 209 to the supplemental protection component. The materials forming one or both of the supplemental shell 208 and second impact mitigation layer 210, as well as the dimensions of the supplemental shell 208 and second impact mitigation layer 210 can be chosen so that a maximum average impact to the region of the supplemental protection component 206 compresses or locally deforms the supplemental shell 208 and underlying second impact mitigation layer 210 so that the supplemental shell 208 nearly contacts the outer shell 202, but does not, so as to absorb a majority of the force of the impact 209. This selection is discussed in greater detail below in the description of FIG. 18. The helmet 201, including outer shell 202 and impact mitigation layer 204 can absorb other impacts that are not position specific.

In some implementations, at least a portion of the supplemental protection component 206 can elastically deform inward toward the forehead of a player or wearer upon impact, and then return to its original configuration after impact. Accordingly, the supplemental protection component 206 may have a first position prior to impact, where the supplemental protection component 206 is in a neutral position, and a second position after impact, where the supplemental protection component 206 undergoes an inward displacement towards the forehead of player or wearer. The extent of the elastic deformation depends on the severity of the impact force, direction and duration, and the supplemental shell 208, and the second impact mitigation structure 210 coupled to the outer shell 202. The elastic deformation of the supplemental protection component 206 results in a localized compression.

For example, the impact 209 on the supplemental protection component 206 may be a frontal impact with an impact velocity of 3 m/s. The supplemental protection component 206 locally deforms when the supplemental shell 208 is impacted, and the second impact mitigation layer 210 is deformed by the supplemental shell 208 local deformation. The local deformation of the supplemental protection component 206 absorbs the impact, reducing the effect of the impact on the player's head within the helmet 201. The material of the impact mitigation layer 204 within the helmet 201 can be designed and chosen to be stiffer than the supplemental shell 208 and second impact mitigation layer 210, so that the helmet 201 can absorb or mitigate general impacts having higher velocities, e.g., velocities of up to 10 m/s. For example, the impact mitigation layer 204 may have 20% greater stiffness than the second impact mitigation layer 210. Accordingly, in the event of an impact 209, the supplemental protection component 206 provides a first impact response by absorbing a particular impact force to the supplemental protection component 206, and the helmet 201 and impact mitigation layer 204 provides a second impact response by absorbing an additional impact force (e.g., any residual impact force remaining after the first impact response offered by the supplemental protection component 206). For example, the impact 209 can be an impact by another player on the supplemental protection component 206, which is absorbed by the response of the supplemental protection component 206. The impact 209 can cause the player to fall to the ground, causing a second, higher velocity impact, which can be absorbed by the helmet 201 including impact mitigation layer 204. In another example, the second impact mitigation layer 210 may have 20% greater stiffness than the impact mitigation layer 204, and the supplemental shell 208 is coupled to a rear portion of the outer shell 202. The second impact mitigation layer 210 can then absorb or mitigate general impacts having a velocity of 13-14 m/s or more, by fully compressing the full extent of the layer thickness 221 upon impact.

In some implementations, the supplemental protection component 206 can incorporate additional or different impact absorption methods. In some implementations, at least a portion (e.g., center portion) of the supplemental protection component 206 and/or the supplemental shell 208 allows movement and/or sliding towards and away from the crown of the helmet 201 to facilitate absorption of impacts. The sliding of the supplemental protection component 206 can be implemented in combination with the local deformation of the supplemental protection component in the region of the impact. In some implementations, the supplemental protection component 206 may further comprise a vibration dampening layer above or below the second impact mitigation layer 210. In some implementations, the second impact mitigation layer 210 is bonded to an interior surface of the supplemental shell 208, and the bonding dampens vibrations leading to a reduced experience of vibrations by an individual wearing the helmet 201.

The helmet assembly 200 may further comprise a liner, a facemask and a chin cup (not shown). As illustrated in FIGS. 2A and 2B, the supplemental protection component 206 can include or accommodate a front connector 212 for attaching the facemask to the helmet 201. In some cases, as will be described further below, the front connector 212 can be used to attach the supplemental protection component 206 to the helmet 201.

An optimized helmet design or a position-specific helmet can incorporate additional or supplemental protection elements that may be tailored to the particular demands of each player and/or player position. The supplemental protection component 206 can be incorporated with a helmet 201 by (1) retrofitting a commercially available helmet with or without minor modifications, (2) retrofitting a commercially available helmet with significant helmet modifications, and/or (3) designing a new, customized helmet system incorporating player-specific and/or position-specific protective features and/or attributes.

In implementations in which the helmet 201 is a commercially available helmet, or where the helmet 201 is a custom-design helmet with a removable supplemental protection component 206, the supplemental protection component 206 may be coupled to a portion of the helmet, so as to cover one or more specific regions of the helmet. The specific regions may include any of one frontal region (or front), an occipital region (or lower-back), a mid-back region, a parietal region (or midline), and a temporal region (right and/or left sides), the orbit region, the mandible (front, right and/or left side) region, the maxilla region, the nasal region, zygomatic region, the ethmoid region, the lacrimal region, the sphenoid region and/or any combination thereof. The supplemental protection component 206 may comprise a supplemental impact protective system, one or more one or more supplemental impact protection elements individual assemblies, one or more supplemental impact protective pads, one or more supplemental impact protective bumpers, one or more supplemental impact domes, and/or any combination(s) thereof. The supplemental protection component 206 may be removably coupled to the helmet 201 by magnetic fasteners, snaps, rivets, screws, hook and loop fabric fasteners, removable adhesive, or any other suitable fastener.

In some implementations, a position-specific helmet may comprise a modular helmet assembly. The modular helmet assembly may comprise multiple helmet modular portions. Each of the multiple helmet modular portions may correspond to one or more various specific regions. The specific regions can comprise a frontal region (or front), an occipital region (or lower-back), a mid-back region, a parietal region (or midline), and a temporal region (right and/or left sides), the orbit region, the mandible (front, right and/or left side) region, the maxilla region, the nasal region, zygomatic region, the ethmoid region, the lacrimal region, the sphenoid region and/or any combination(s) thereof. One or more of the helmet modular portions may comprise a supplemental impact protective element and/or a supplemental impact protective material. Each of the multiple helmet modular portions may be removably connected to each of the adjacent multiple helmet modular portions.

Figure 3:
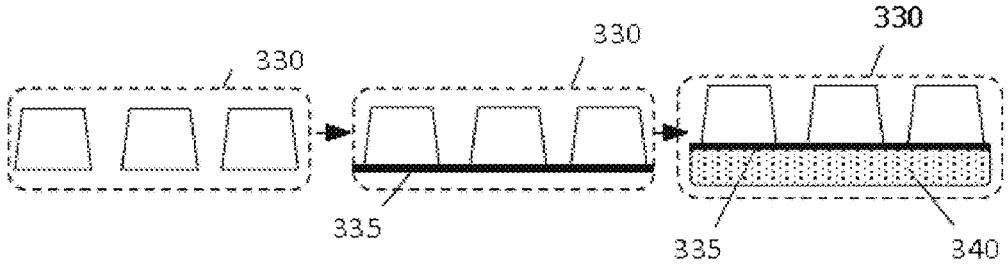
FIG. 3 shows a cross-sectional view of an example impact mitigation structure formed as truncated cones.
Figure 4:
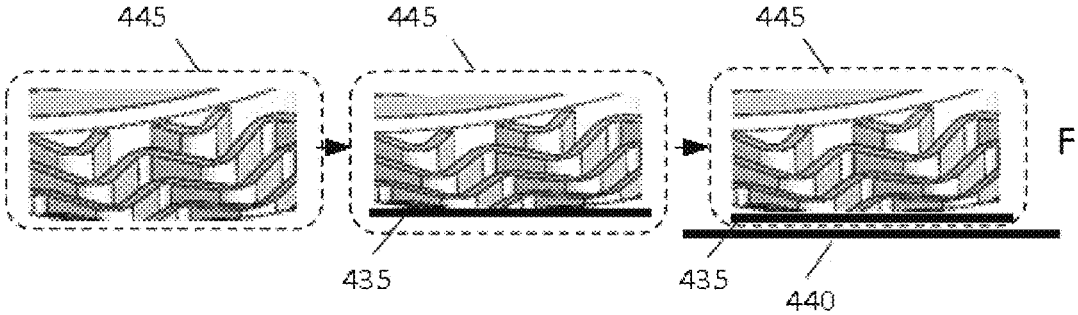
FIG. 4 shows a perspective view of an example impact mitigation structure formed as undulating walls of material.
Figure 5:
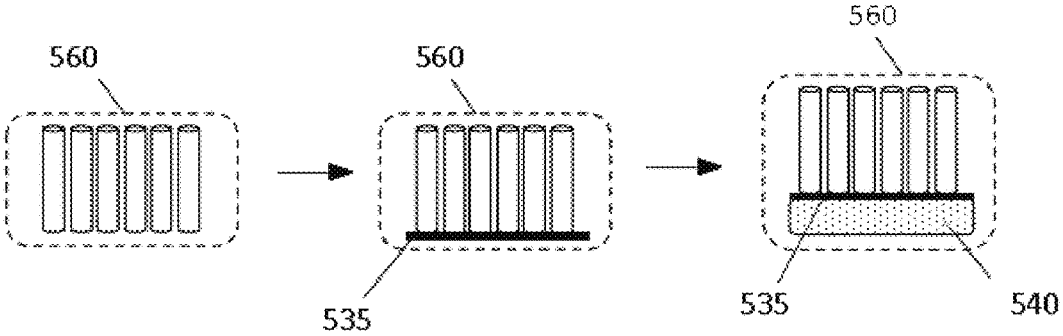
FIG. 5 shows a cross-sectional view of an example impact mitigation structure formed as filament structures.

In some implementations, the second impact mitigation layer 210 includes multiple mitigating structures in a patterned array, which can be separate from one another or connected to assemblies or arrays. FIGS. 3-5 show examples of impact mitigation structures in several stages of connection that can be implemented in the second impact mitigation layer 210 of the supplemental protection component 206. FIG. 3 shows a truncated cone-shaped impact mitigation structures 330. FIG. 4 shows an impact mitigation structure formed as undulating walls of material 445. FIG. 5 shows columnar or filament-based impact mitigation structures 560.

FIGS. 3-5 illustrate implementations in which the impact mitigation structures of the second impact mitigation layer are arranged into a patterned array of elements and formed as separate elements joined by a base membrane 335, 435, 535, or elements joined by a base membrane 335, 435, 535 and foam layer 340, 440, 540. In FIGS. 3-5, the base membrane 335, 435, 535 and foam layer 340, 440, 540 serve to orient and position the impact mitigation structures 330, 430, 530 with respect to one another, and may also impact the stiffness of the mitigation structures 330, 430, 530. In some implementations, the joining of the mitigation structures 330, 430, 530 by a base membrane 335, 435, 535 or foam layer 340, 440, 540 are a part of the manufacturing process and facilitate efficient manufacture of the supplemental protection component 206.

The base membrane 335, 435, 535 can be a loosely or tightly woven fabric. The fabric may be polymeric, such as polypropylene, polyethylene, polyester, nylon, PVC, PTFE, and/or any combination thereof. The fabric may be 2-way or 4-way stretch material. Furthermore, the base membrane 335, 435, 535 or foam layer 340, 440, 540 can be breathable and moisture wicking. In some implementations, the base membrane 335, 435, 535 or foam layer 340, 440, 540 completely or continually cover an entire array of impact mitigating structures 330, 430, 530. In other implementations, the base membrane 335, 435, 535 or foam layer 340, 440, 540 covers at least a portion of an entire array of impact mitigating structures 330, 430, 530. In other implementations, the base membrane 335, 435, 535 or foam layer 340, 440, 540 covers selected or segmented arrays of impact mitigating structures 330, 430, 530 or individual impact mitigating structures (not shown).

The foam layer 340, 440, 540 can include polymeric foams, quantum foam, polyethylene foam, polyurethane foam (foam rubber), XPS foam, polystyrene, phenolic, memory foam (traditional, open cell, or gel), impact absorbing foam, latex rubber foam, convoluted foam ("egg create foam"), Evlon foam, impact hardening foam, and/or any combination thereof. The foam layer 340, 440, 540 may have an open-cell structure or closed-cell structure. The foam layer 340, 440, 540 can include multiple layers. The foam layer 340, 440, 540 can be further tailored to obtain specific characteristics, such as anti-static, breathable, conductive, hydrophilic, high-tensile, high-tear, controlled elongation, and/or any combination thereof.

FIG. 3 shows truncated cone-shaped impact mitigation structures 330, which can be formed as individual hexagonal structures. The impact mitigation structures 330 can be formed as individual impact mitigation structures 330, which are unconnected and can be individually placed between the supplemental protection component 206 and the outer shell 202 and may be affixed to the inner surface of the supplemental shell 208. The impact mitigation structures 330 can optionally or alternatively be coupled to a base membrane 335 so that the impact mitigation structures 330 are formed into an array. As described above, in some implementations, the impact mitigation structures 330 can optionally or alternatively be coupled to the base membrane 335, and the base membrane 335 can be coupled to a foam layer 340.

FIG. 4 shows impact mitigation structures 445 formed as undulating walls of material. The impact mitigation structures 445 may be formed from an auxetic material. The impact mitigation structures 445 can be formed as individual impact mitigation structures 445, which are unconnected and can be individually placed in the supplemental protection component 206 and affixed to the inner surface of the supplemental shell 208 or an outer shell 202 of the helmet 201. The impact mitigation structures 445 can optionally or alternatively be coupled to a base membrane 435 so that the impact mitigation structures 445 are formed into an array. In some implementations, the impact mitigation structures 445 can optionally or alternatively be coupled to the base membrane 435, and the base membrane 435 can be coupled to a foam layer 440.

FIG. 5 shows impact mitigation structures 560 formed as columns or filament structures. The impact mitigation structures 560 can be formed as individual impact mitigation structures 560, which are unconnected and can be individually placed between the supplemental protection component 206 and the outer shell 202, and may be affixed to the inner surface of the supplemental shell 208. The impact mitigation structures 560 can optionally or alternatively be coupled to a base membrane 535 so that the impact mitigation structures 560 are formed into an array. In some implementations, the impact mitigation structures 560 can optionally or alternatively be coupled to the base membrane 535, and the base membrane 535 can be coupled to a foam layer 540.

Figure 6:
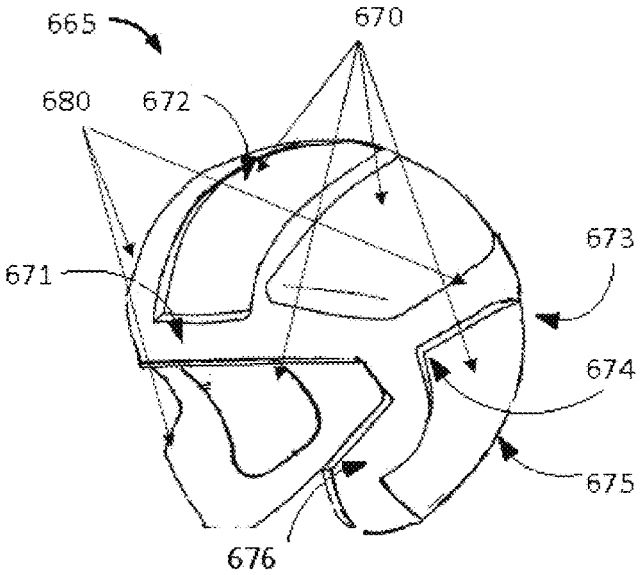
FIG. 6 shows a perspective view of a helmet illustrating regions on the helmet where impact mitigation structures can be applied.

FIG. 6 shows a perspective view of a helmet 665 illustrating regions on the helmet where impact protection structures (for example supplemental protection component 206) incorporating impact mitigation structures such as impact mitigating structures 330, 430, 530 of FIGS. 3-5 can be applied. The helmet 665 includes multiple regions, including a frontal region 671, a top or crown region 672, a rear or back region 673, a side region 674, a lower rear region 675, and a jaw region 676. The impact protection structures can be attached to the helmet 665 at any of these regions which are desired to be protected. As will be described further with respect to FIG. 18, the impact protection structures or supplemental protection component can be purposefully designed to protect a particular region of a players head and can be affixed to a corresponding region of the helmet 665, such as the frontal region 671, the top or crown region 672, the rear or back region 673, the side region 674, the lower rear region 675, the jaw region 676, or any other desired region.

In some implementations, the helmet 665 includes at least a portion of a helmet with a first material 670 and a second material 680. In some implementations, the first material 670 is a material used in the supplemental protection component or components of the helmet 665 and the second material 680 is a materials used in the outer shell of the helmet 665. In some implementations, the first material 670 and the second material 680 are the same material. In other implementations, the first material 670 and the second material 680 are different materials having different material characteristics, for example different stiffness, hardness, flexibility, or elasticity. In some implementations, the first material 670 and the second material 680 are non-porous materials. In some implementation, the helmet 665 includes one or more apertures through the first material 670 and/or the second material 680, so as to allow breathability and airflow through the helmet 665 and/or to allow for coupling of various components to the helmet 665 through the apertures. In some implementations, the first material 670 and the second material 680 are painted.

In some implementations, the first material 670 and/or second material 680 at least may comprise relatively rigid and/or hard components (i.e., "hard" components). Alternatively, the first material 670 and/or second material 680 may comprise a deformable, and/or flexible material. Such different types of first and second materials can be incorporated in a framework or "shell" configuration of less rigid and/or more flexible components (i.e., "Hytrel" components) for a position-specific purpose. For example, the helmet 665 could comprise a base framework of Hytrel or similar materials, with plates or inserts of a harder and/or more rigid material. If desired, the various components could be co-molded and/or otherwise integrally formed (i.e., by injection molding of a skeletal frame, for example), while in other implementations the various components could be modular and/or removable, as necessary and/or desired. Alternatively, the first and/or second materials may be recessed, the recesses sized and configured to receive a supplemental impact protective element. Accordingly, the first and/or second materials may be a raised surface.

Figure 7A:
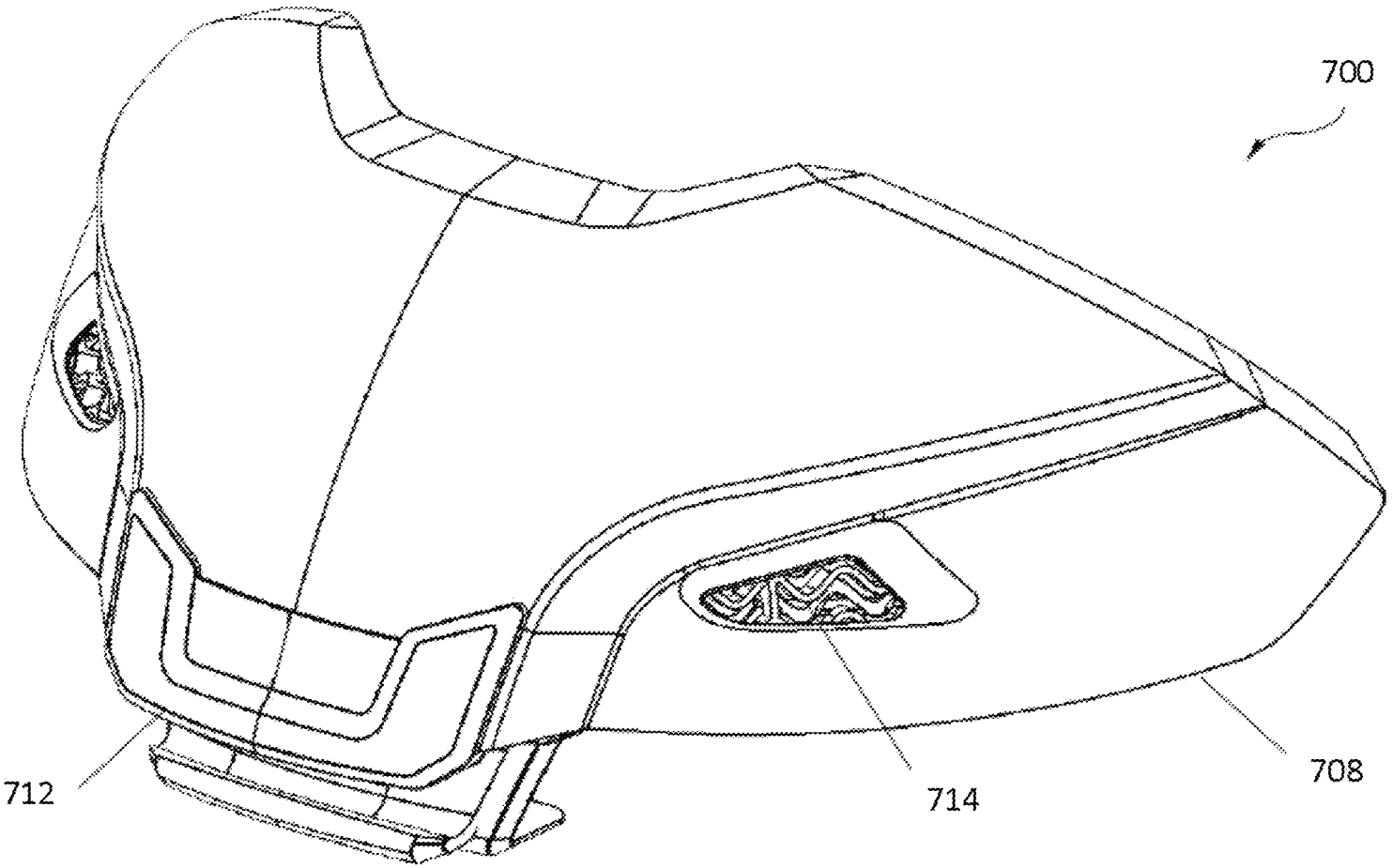
FIG. 7A shows a front perspective view of a supplemental protection component.
Figure 7B:
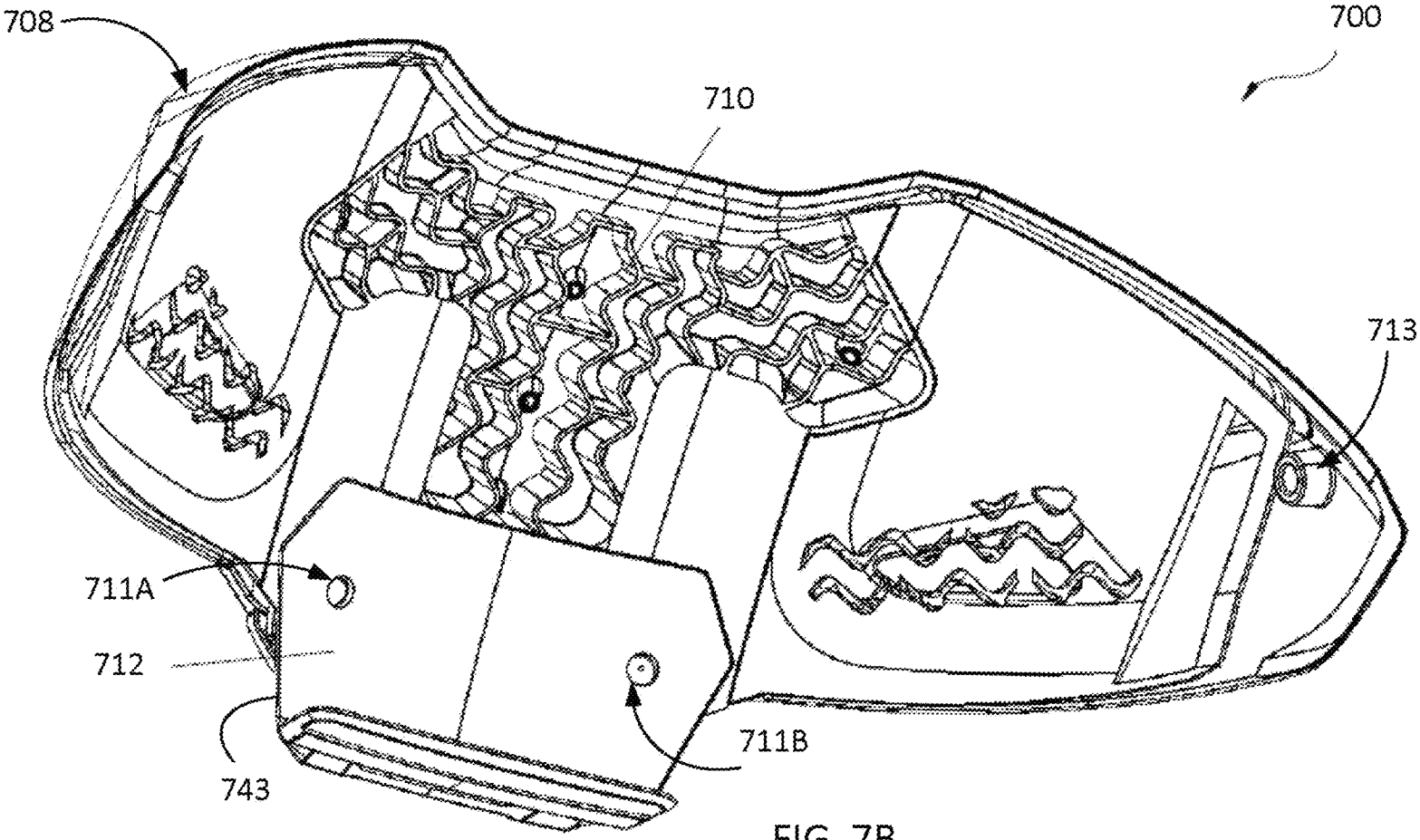
FIG. 7B shows a back perspective view of a supplemental protection component.

FIGS. 7A and 7B show perspective views of a supplemental protection component 700, such as supplemental protection component 206 of FIGS. 2A and 2B. The supplemental protection component 700 can be utilized with a wide variety of helmet designs and/or sizes. The supplemental protection component 700 can include a supplemental shell 708 and supplemental impact mitigation structure 710. The supplemental shell 708 includes a curved body having an attachment bumper assembly 712. The supplemental shell 708 can include one or more apertures 714 to provide air flow and breathability. In some implementations, the apertures 714 extend through the supplemental shell 708 and not through the supplemental impact mitigation structure 710, such that the supplemental impact mitigation structure 710 is visible through the aperture 714, as illustrated in FIG. 7A. In other implementations, the aperture 714 extend through the supplemental shell 708 and the supplemental impact mitigation structure 710. The supplemental protection component 700 can include an attachment bumper assembly 712 for attachment of a facemask, visor, or other component, and/or for coupling the supplemental protection component 700 to an underlying helmet. The attachment bumper assembly 712 is further illustrated in the exploded view of FIG. 7C.

The supplemental impact mitigation structure 710 can be any of the impact mitigation structures described in FIGS. 3-5, or any other suitable impact mitigation structure or material. The supplemental impact mitigation structure 710 can fill an interior of the supplemental shell 708, or, as illustrated in FIG. 7B, can be positioned strategically in certain regions of the supplemental shell 708.

FIG. 7B shows the supplemental impact mitigation structure 710 as an auxetic material arranged in undulating walls of material perpendicular to an inner surface of the supplemental shell 708. FIG. 7B shows a backside of the attachment bumper assembly 712 including attachment holes 711A and 711B for attaching the supplemental protection component 700 to a helmet using screws or other fasteners inserted through attachment holes 711A and 711B from the front side of the supplemental shell 708 through the back side of the supplemental shell 708 and into the helmet. The attachment holes 711A and 711B also serve to attach the attachment bumper assembly 712 to the helmet. In some implementations, the supplemental protection component 700 includes a flat portion 743 (shown in FIG. 7C) configured to engage with a back of the attachment bumper assembly 712, the flat portion 743 including attachment holes 711A and 711B or attachment holes aligned with attachment holes 711A and 711B. Additional attachment mechanisms such as connector stud 713 can also be positioned on an inner surface of the supplemental protection component 700 to attach the supplemental protection component 700 to a helmet, or on an outer surface of the supplemental protection component 700 supplemental shell 708 to allow attachment of additional components.

Figure 7C:
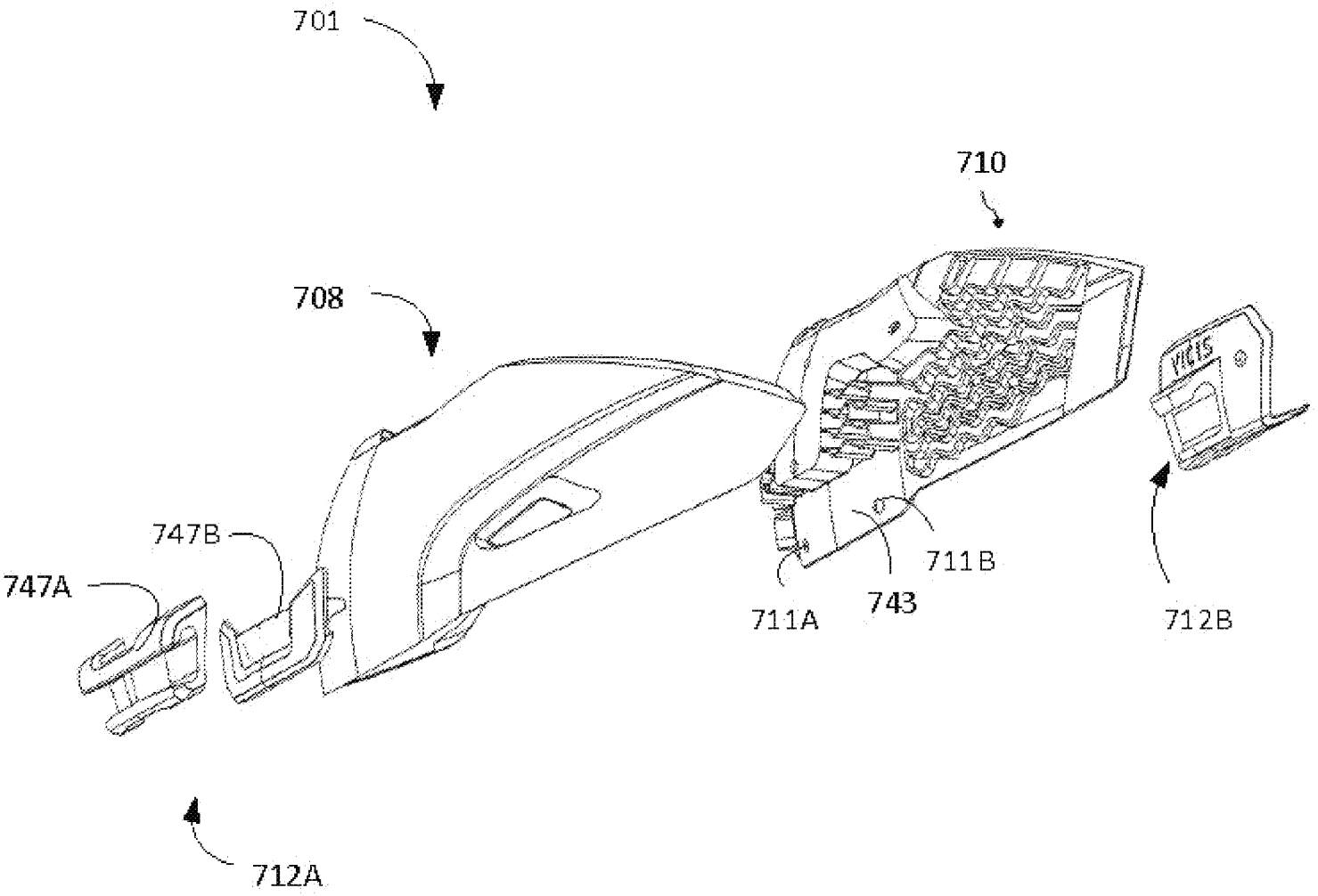
FIG. 7C shows an exploded view of a supplemental protection component.
Figure 8A:
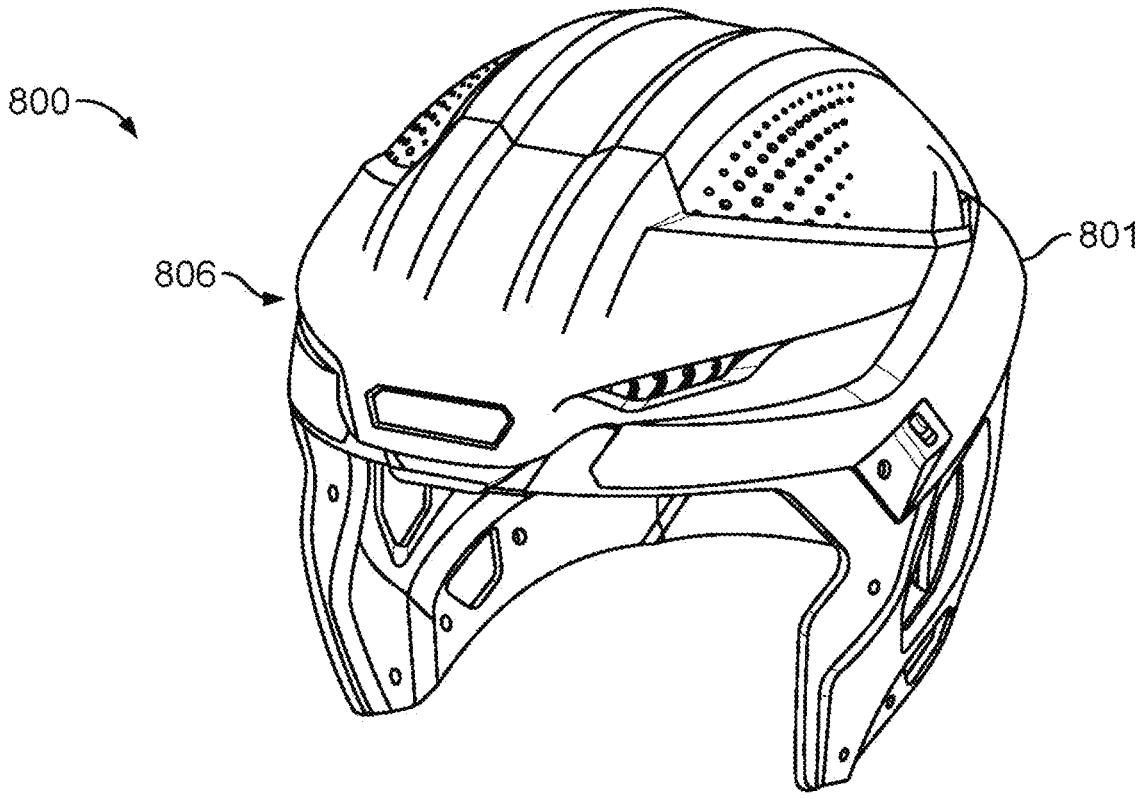
FIG. 8A shows a front perspective view of an example helmet having a supplemental protection component on a forward portion of the helmet.
Figure 8B:
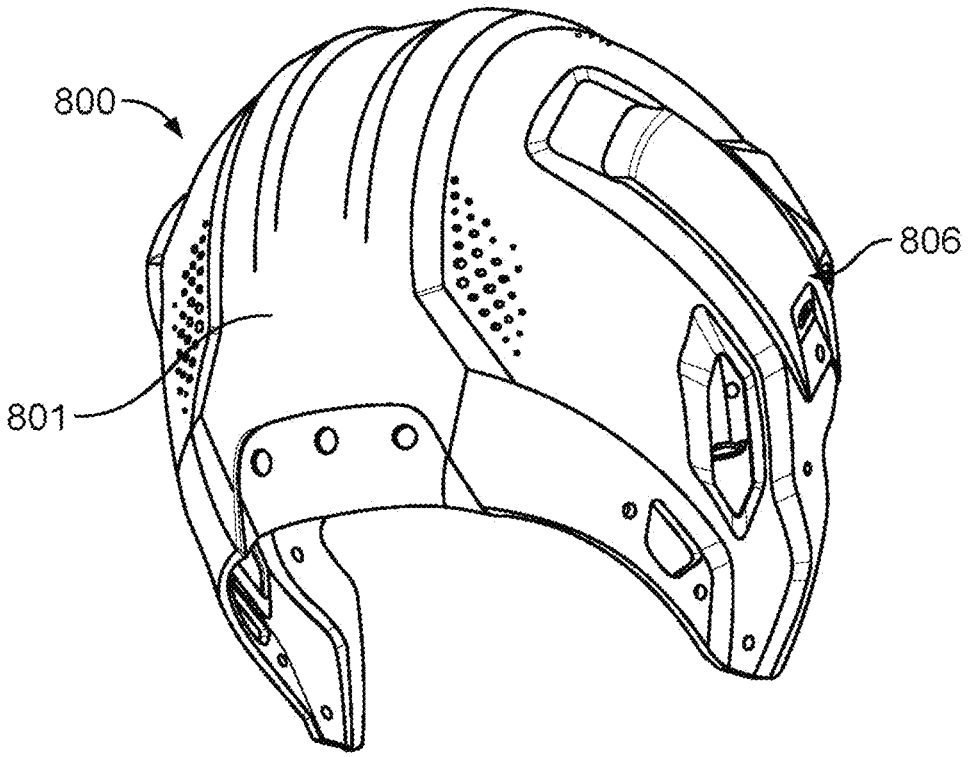
FIG. 8B shows a back perspective view of the example helmet of FIG. 8A.
Figure 8C:
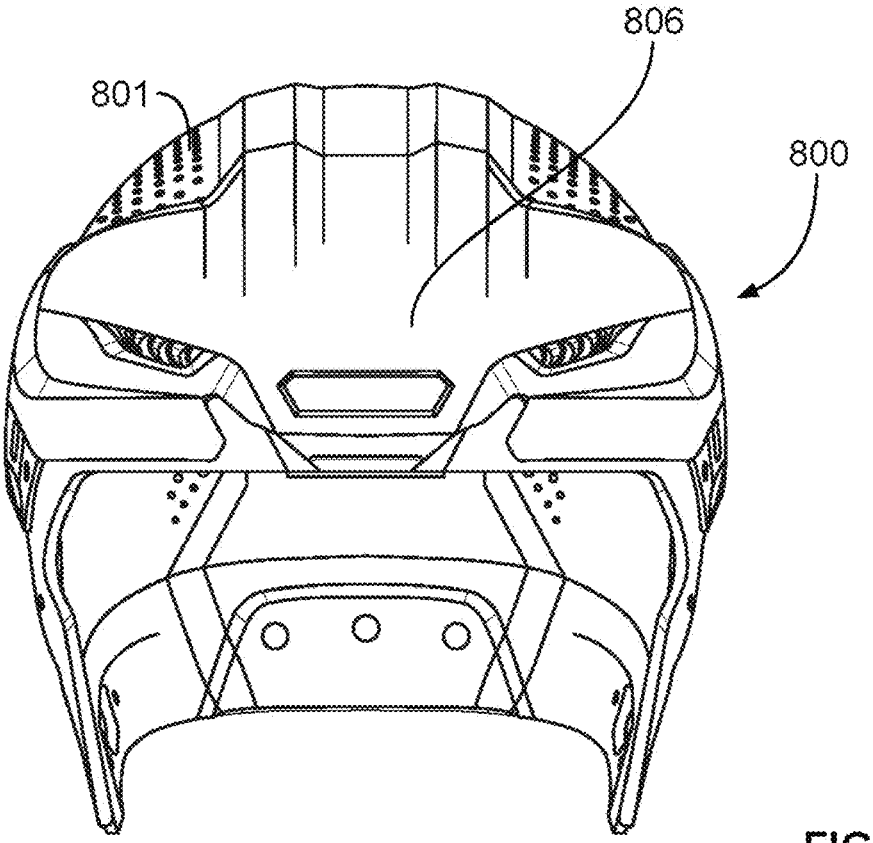
FIG. 8C shows a front view of the example helmet of FIG. 8A.
Figure 8D:
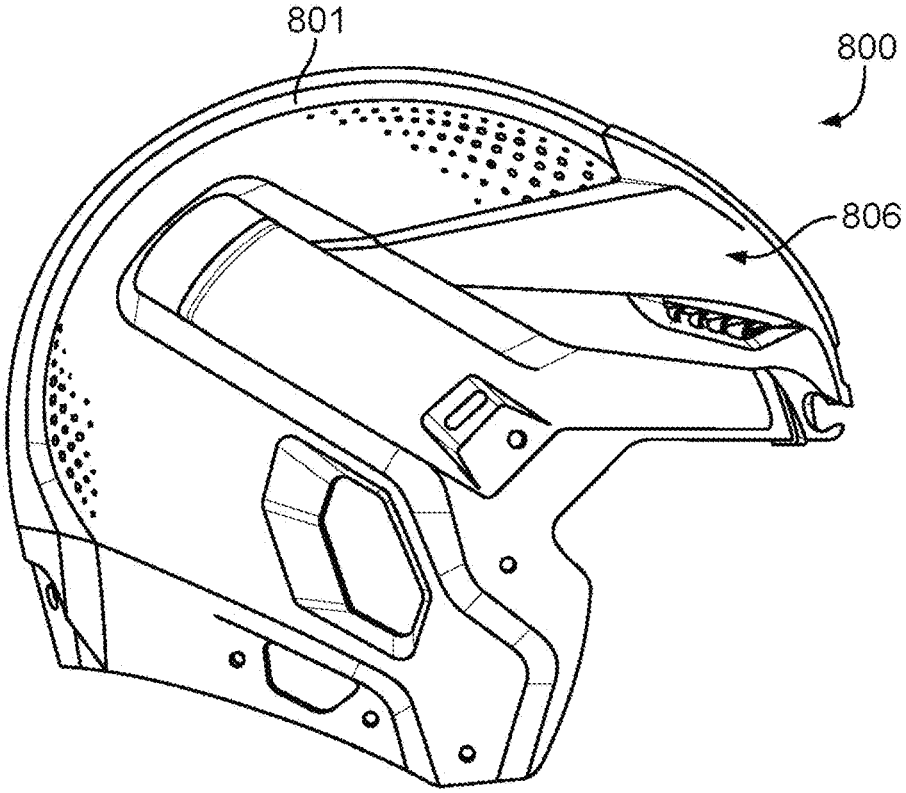
FIG. 8D shows a side view of the example helmet of FIG. 8A.

FIG. 7C shows the exploded view 701 of the supplemental protection component 700. The supplemental shell 708 is shaped to fit over the supplemental impact mitigation structure 710, which may be coupled to the supplemental shell 708 by screws, connection studs, other fasteners, or by adhesive or permanent bonding. The attachment bumper assembly 712 shown in FIGS. 7A and 7B is illustrated in FIG. 7C in two versions: attachment bumper assembly 712 A has two connecting portions 747A and 747B, and attachment bumper assembly 712B is formed as a unitary bumper assembly. The connector assemblies 712A and 712B are described in greater detail below in FIGS. 10A-E, 11A-B, 12A-E, and 13A-E.

FIGS. 8A-8D show isometric views of an example helmet assembly 800 having a supplemental protection component 806 on a forward portion of the helmet 801. As described above, the helmet 801 and supplemental protection component 806 can include one or more apertures. The supplemental protection component 806 can be coupled to the helmet 801 or can be formed as part of the helmet 801 so as not to be removable. The supplemental protection component 806 can extend over the forward region of the helmet 801, and can additionally or alternatively extend over one or more other portions of the helmet 801, for example, extending back towards or beyond a coupling aperture for a visor or facemask. The outer surface of the helmet 801 can include one or more decorative features, including ridges, lines, or perforations. In some implementations, the helmet 801 and supplemental protection component 806 can be painted so as to match each other and to have a team color or design. In some implementations, the helmet 801 and supplemental protection component 806 are designed to allow a membrane or skin (for example, a decal) to be placed over and affixed to an outer surface of the helmet 801 and supplemental protection component 806 to give the helmet assembly 800 the color or design of a team.

Figure 9:
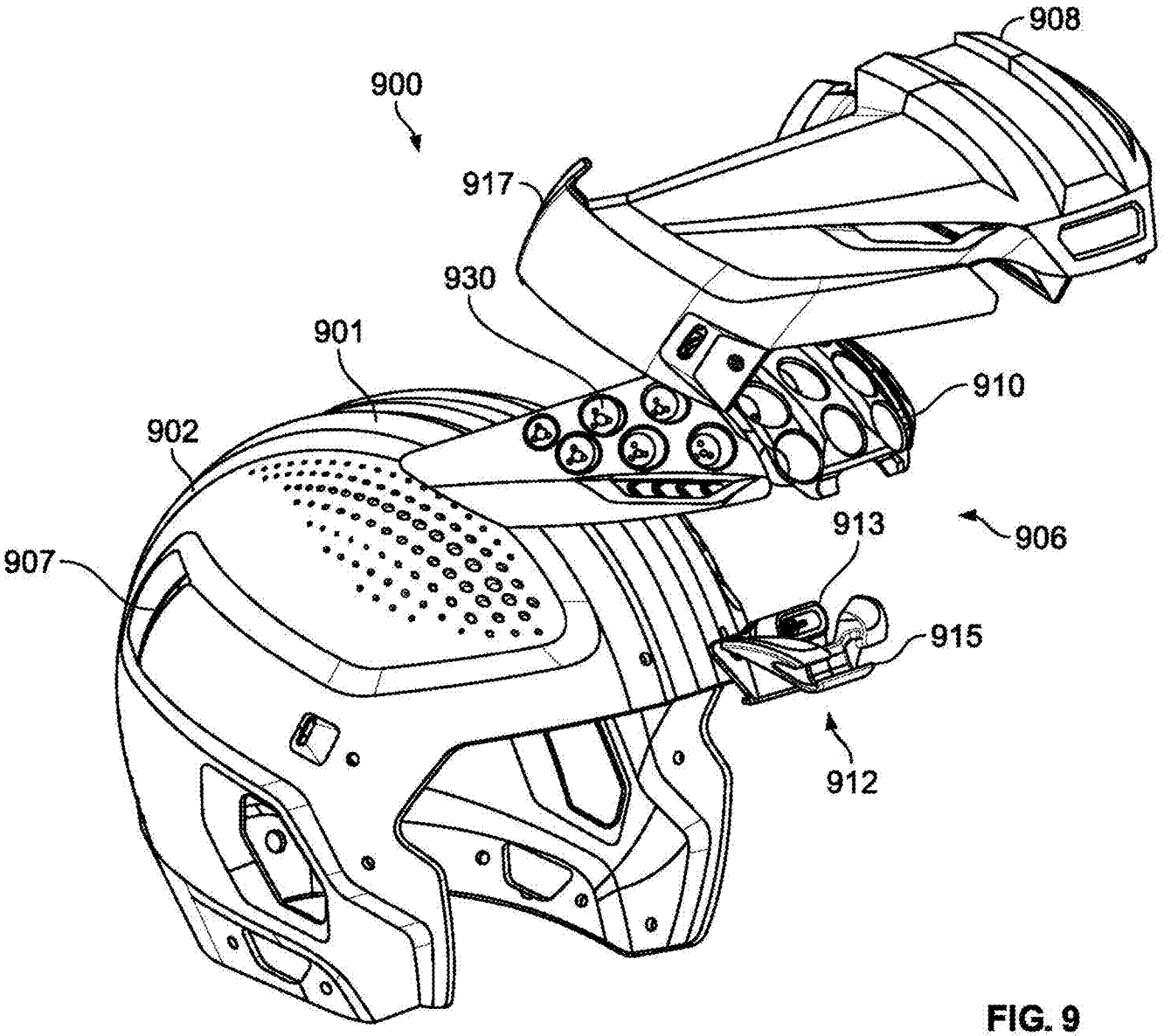
FIG. 9 shows an exploded view of an example helmet having a supplemental protection component on a forward portion of the helmet.

FIG. 9 shows an exploded view of helmet assembly 900 having a supplemental protection component 906 on a forward portion of the helmet 901. The helmet assembly 900 includes helmet 901, supplemental protection component 906, and attachment bumper assembly 912. Each side of the helmet 901 includes a side aperture 907, which may be used to couple the supplemental protection component 906 to the helmet, for attachment of other components, or to provide airflow through the helmet. The supplemental protection component 906 includes a supplemental shell 908 and supplemental impact mitigation layer 910, the supplemental impact mitigation layer 910 is formed as a layer of indented dome structures positioned beneath the supplemental shell 908 and above an outer surface of the helmet 901. The supplemental impact mitigation layer 910 and supplemental shell 908 are designed to locally and elastically deform in response to an impact to the supplemental protection component 906 so as to absorb the force of the impact prior to the impact force radiating to the helmet 901. As described above, the design of the supplemental protection component 906 may be specific to a particular player position and the shape, dimensions, position and materials may be chosen to absorb and mitigate the effect of the types of forces and impacts that are common to that player position.

The attachment bumper assembly 912 includes front bumper portion 915, which includes a passage for connecting a facemask to the front bumper portion 915, as well as a back bumper portion 913. Front bumper portion 915 is designed to be placed on top of the supplemental protection component 906 on an outer surface of the supplemental shell 908 or over a flat projecting portion of the underlying supplemental impact mitigation layer 910. The back bumper portion 913 (for example attachment bumper assembly 712 in FIGS. 7A-C) is configured to be placed behind the supplemental protection component 906 (for example, behind flat portion 743 in FIG. 7C) and above the outer surface of the helmet 901. The front bumper portion 915 is then attached to the supplemental protection component 906, back bumper portion 913, and helmet 901 by screws or other fasteners that pass through each of these components, coupling the components together.

In some implementations, a portion of the supplemental protection component 906 is coupled to a portion of the helmet 901 and/or to a region on the helmet. In some implementations, at least a portion of the supplemental protection component 906 is coupled to a portion of the outer shell and/or within a region of the outer shell of the helmet 901. In some implementations, the supplemental protection component 906 can further include one or more wings extending rearward from the supplemental impact mitigation layer 910, and having a fastener 917 at a rearward edge. The fastener 917 can be sized and shaped to be threaded into the side aperture 907 to provide additional coupling and stability to the supplemental protection component 906.

In some implementations, the supplemental protection component 906 may comprise at least a portion of one surface that matches or substantially matches the contours of the helmet. More specifically, the supplemental protection component 906 may comprise at least a portion one surface that matches or substantially matches the contours of the outer shell of the helmet 801. The edges of the supplemental protection component 906 abutting the outer surface of the helmet 901 can be shaped so as to be flush with the outer surface to prevent the supplemental protection component 906 from being ripped off, snagged, or otherwise detached during game play. Producing edges of the supplemental protection component 906 designed to be flush with the outer surface of the helmet 901 can further serve to fully surround the supplemental impact mitigation layer 910 to prevent water or debris from entering and degrading the materials or structures therein.

The supplemental protection component 906 can be utilized with a wide variety of helmet designs and/or sizes. As described above in FIGS. 3-5, the supplemental protection component 906 can include a supplemental impact mitigation layer 910 comprising multiple impact mitigation structures, which may be coupled to a base membrane and/or foam layer, or can be formed as a single structure for placement between the supplemental shell 908 and the outer surface 902 of the helmet. In some implementations, the supplemental impact mitigation layer 910 is bonded or coupled by a strong adhesive to an inner surface of the supplemental shell 908 to prevent movement of the supplemental impact mitigation layer 910 beneath the supplemental shell 908. In some implementations, the supplemental impact mitigation layer 810 is coupled to an outer surface of the outer shell, instead of to the supplemental shell 808, As described herein, the supplemental protection component 906 may be coupled to a portion of the helmet 901 and/or a portion of the outer surface or external surface of the outer shell of the helmet 901. In some implementations, the supplemental shell 908 is coupled to the outer shell 902. In some implementations, the supplemental shell 808 is coupled to the supplemental impact mitigation layer 910 but not to the outer shell 902 of the helmet 901, and the supplemental impact mitigation layer 910 is coupled to the outer shell 902. The coupling of the supplemental protection component 906 to a portion of the helmet 901 may cover one or more specific regions of the helmet or by in proximity to one or more specific regions of the helmet, including one or more of a frontal region (or front), an occipital region (or lower-back), a mid-back region, a parietal region (or midline), and a temporal region (right and/or left sides), the orbit region, the mandible (front, right and/or left side) region, the maxilla region, the nasal region, zygomatic region, the ethmoid region, the lacrimal region, the sphenoid region and/or any combination thereof.

In some implementations, the supplemental protection component is permanently attached or formed as part of the helmet. In other implementations, the supplemental protection component is configured to be removably coupled to the helmet, so that the supplemental protection component can be used with commercially available helmets and supplemental protection components designed for different positions can be interchanged on the helmet. FIGS. 10A-B, 11A-E, 12A-E, and 13A-E show views of example connectors for mounting a removable supplemental protection component on a forward portion of a helmet.

Figure 10A:
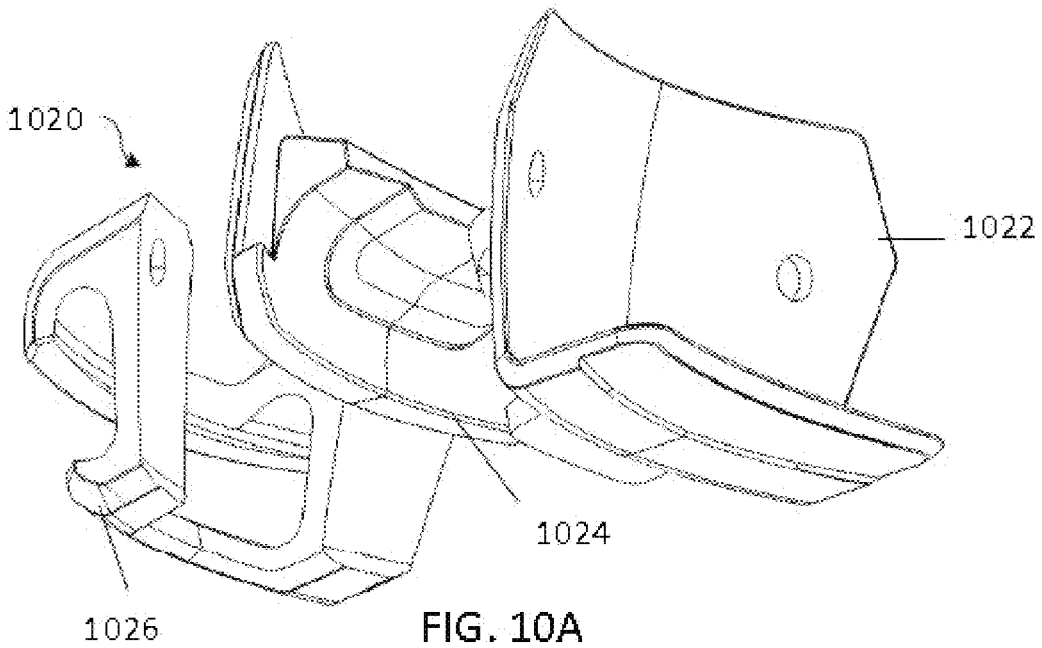
FIG. 10A shows an exploded rear view of an example connector for mounting a removable supplemental protection component on a forward portion of a helmet.
Figure 10B:
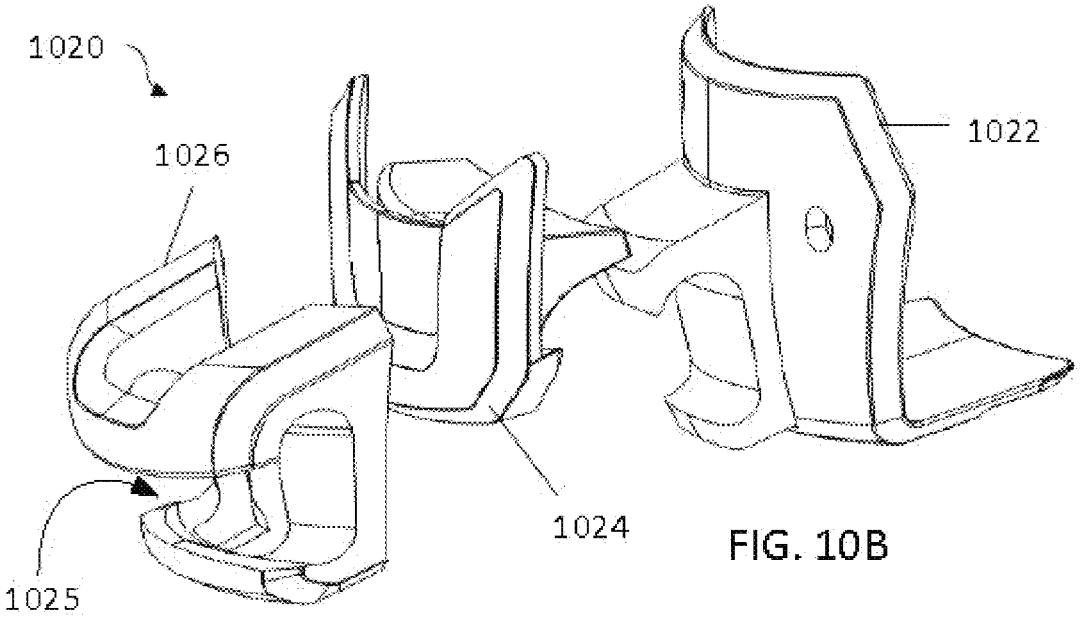
FIG. 10B shows an exploded front view of the example connector of FIG. 10A.

FIGS. 10A-10B illustrate different isometric views of a bumper attachment assembly 1020. The bumper attachment assembly 1020 is coupled to the helmet and the supplemental protection component, and attaches the supplemental protection component to the outer shell of the helmet. The bumper attachment assembly 1020 desirably facilitates the attachment of the supplemental protection component to a helmet, including a commercially available helmet. The bumper attachment assembly 1020 comprises a back bumper 1022, a central bumper 1024, and a facemask bumper 1026, and/or any combination(s) thereof. In some implementations, the central bumper 1024 is coupled to the supplemental protection component, for example to the supplemental shell, impact mitigation structure, or a base membrane underlying the impact mitigation structure. The facemask bumper 1026 is coupled to the supplemental protection component, for example, the supplemental shell, and to the central bumper 1024, the back bumper 1022, and/or any combination thereof. The back bumper 1022 is coupled to the supplemental protection component, for example, the supplemental shell, impact mitigation structure, or base membrane. The back bumper 1022 can also be coupled to the outer surface of the helmet, the facemask bumper 1026, and/or any combination thereof. The facemask bumper 1026 comprises a channel 1025, the channel 1025 is sized and configured to receive a portion of a facemask (not shown).

Figure 10C:
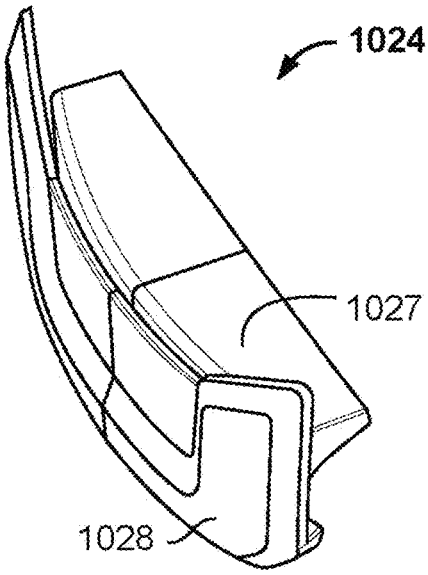
FIG. 10C shows a front perspective view of a central bumper of the example connector of FIG. 10A.
Figure 10D:
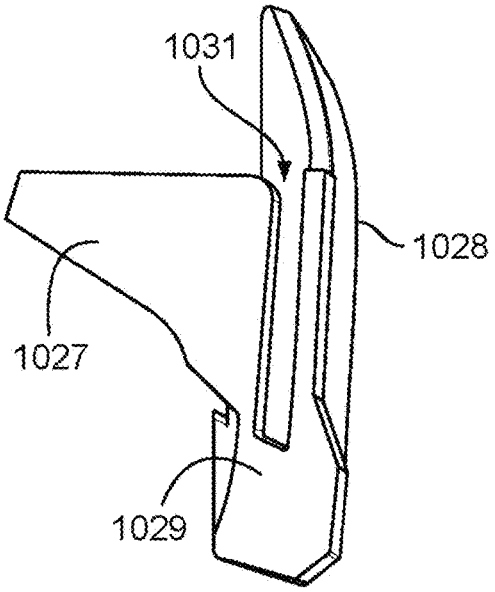
FIG. 10D shows a side view of the central bumper of FIG. 10C.
Figure 10E:
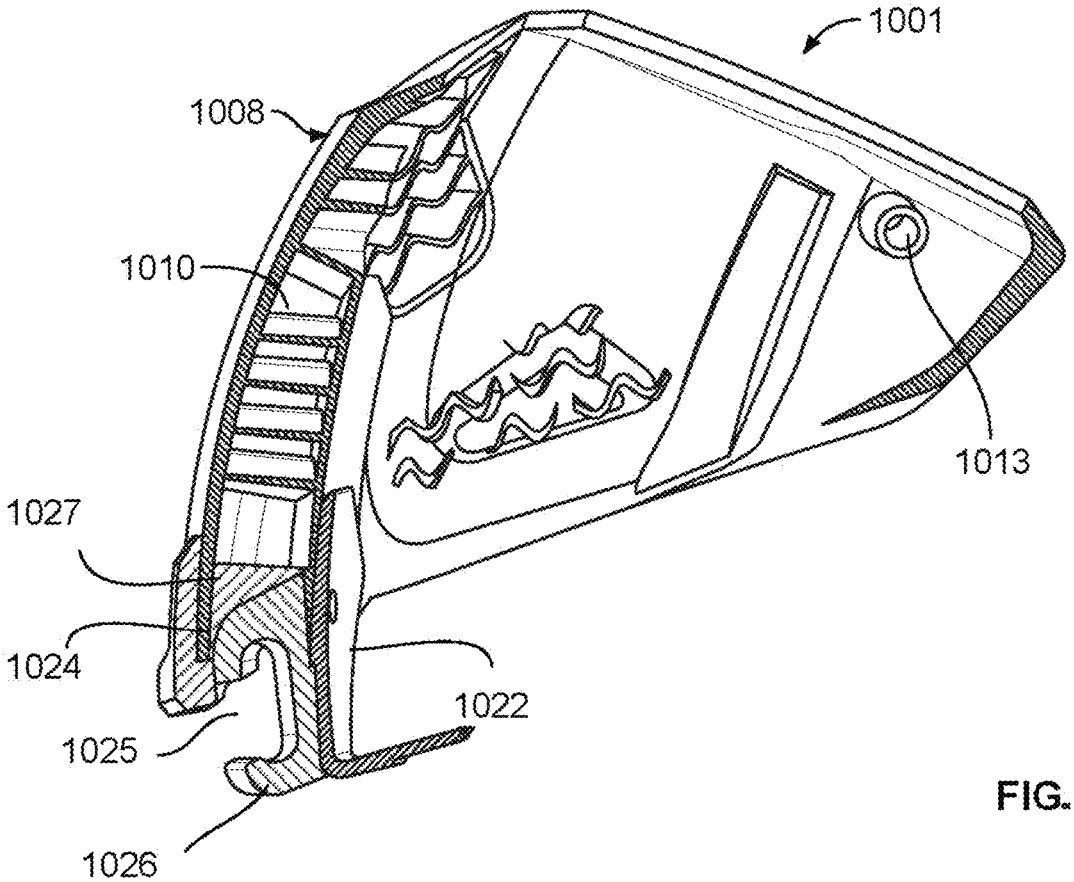
FIG. 10E shows a rear perspective view of a supplemental protection component coupled to a facemask bumper and central bumper of FIGS. 10A-D.

FIG. 10E illustrates an assembled view 1001 of the coupling of the bumper attachment assembly 1020 to the supplemental protection component 1006 including supplemental shell 1008 and impact mitigation structure layer 1010. As illustrated in FIG. 10E, the facemask bumper 1026 overlays supplemental protection component 1006, including a portion of the supplemental shell 1008. The facemask bumper 1026 overlays a flat and exposed portion of the impact mitigation structure layer 1004 which is not covered by the supplemental shell 1008. The central bumper 1024 is coupled to the supplemental shell 1008 by a gap 1031 formed between the back surface 1029 and rear flange 1027 of the central bumper 1024 (described below in FIGS. 10C and 10D). The rear flange 1027 of the central bumper 1024 extends to engage an upper portion of the facemask bumper 1026. Each of the facemask bumper 1026, central bumper 1024, and rear bumper 1022 can include apertures through which screws or other fasteners can be extended to fasten the bumper attachment assembly 1020 together, and to fasten the supplemental protection component 1006 to the helmet (not shown). The supplemental protection component 1006 can further include fastener 1013 for coupling the supplemental protection component 1006 to the outer shell of the helmet. Fastener 1013 can be a snap, a stud, an aperture for receiving a screw, or any other suitable fastening device.

In some implementations, the back bumper 1022 includes a first surface and a second surface. The second surface of the back bumper 1022 is coupled to a portion of the helmet or is coupled to a portion of the outer shell of the helmet. The first surface of the back bumper is coupled to a back surface of the supplemental protection component. The facemask bumper 1026 can also have a first surface and a second surface. The second surface of the facemask bumper 1026 can be coupled to a front surface of the supplemental protection component. The second surface of the facemask bumper 1026 being mated or abutted against the rear flange 1027 of the central bumper 1024.

FIGS. 10C-10D show isometric views of the central bumper 1024. Central bumper 1024 has a front surface 1028, back surface 1029, and rear flange 1027. The front surface 1028 may be shaped to accept a corresponding component of the front bumper 1026. The back surface 1029 can be shaped to abut a flat surface on the supplemental shell 1008 of the supplemental protection component, or a portion of the outer shell of the helmet which is not covered by the supplemental shell. The back surface 1029 can be shaped so as to couple to the surface of the outer shell of the helmet or the supplemental protection component, such that the surfaces are flush. The rear flange 1027 can be shaped and sized so as to extend beneath a front rim of the helmet outer surface or supplemental shell when the bumper attachment assembly 1020 is in place on the helmet.

At least a portion of the rear flange 1027 and the front surface 1028 are spaced apart to define a gap 1031. The gap 1031 is sized and configured to receive a portion of the supplemental protection component 1026 such as a portion of the supplemental shell 1008 or a flat portion of the impact mitigation structure layer 1010, or a membrane overlaying the impact mitigation structure layer 1010. In some implementations, the gap 1031 is sized and configured to receive a portion of the outer shell of the helmet.

In some implementations, the bumper attachment assembly 1020 comprises a metal or a polymer material. The polymer material may comprise elastic or viscoelastic properties. The elasticity may facilitate independent action from the helmet and to absorb forces rather than transferring forces to the helmet or having the bumper attachment assembly 1020 fail.

Figure 11A:
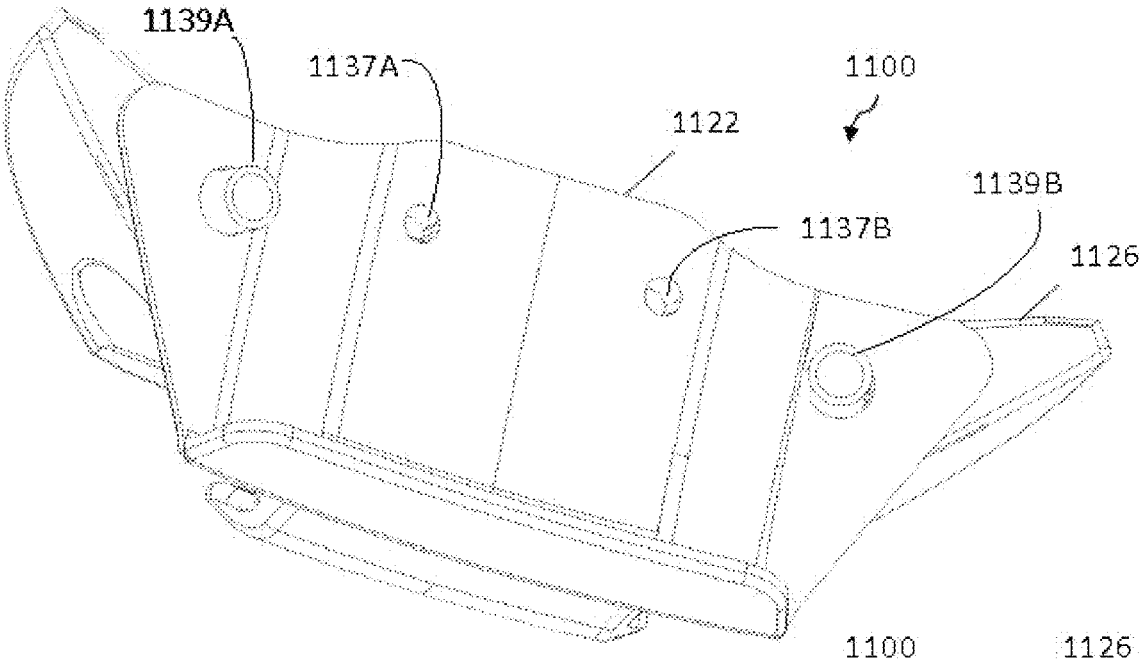
FIG. 11A shows a bottom perspective view of an example connector for mounting a removable supplemental protection component on a forward portion of a helmet.
Figure 11B:
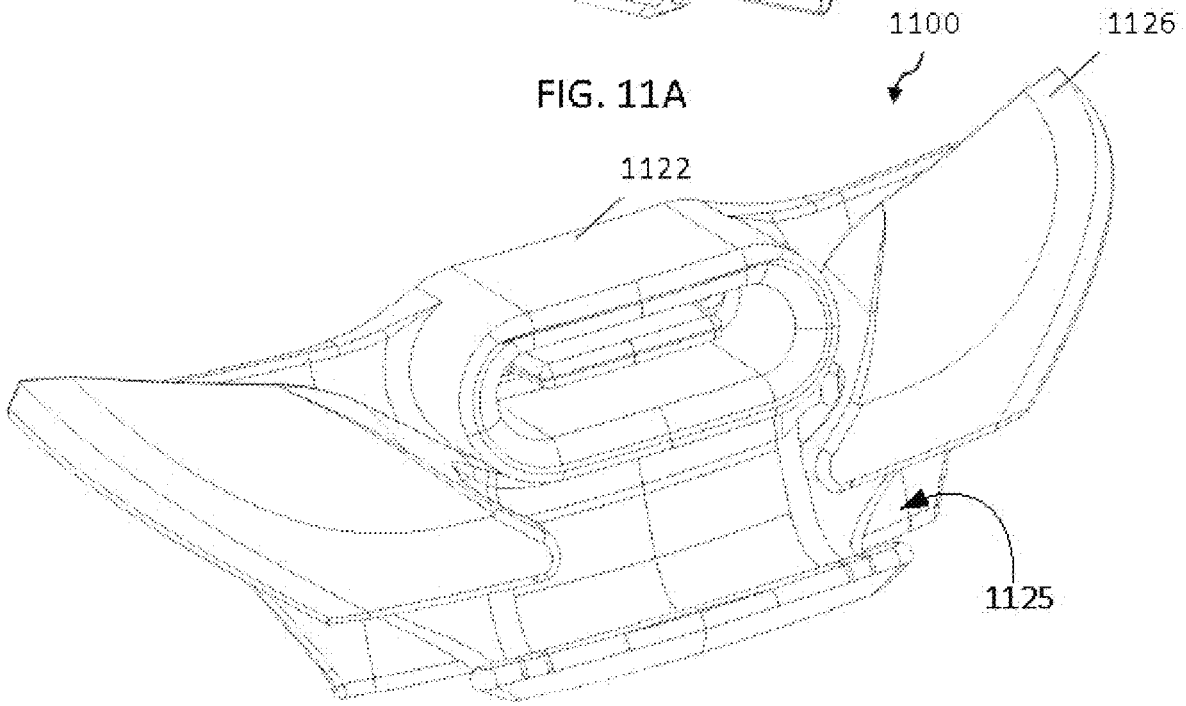
FIG. 11B shows a front perspective view of the example connector of FIG. 11A.
Figure 12A:
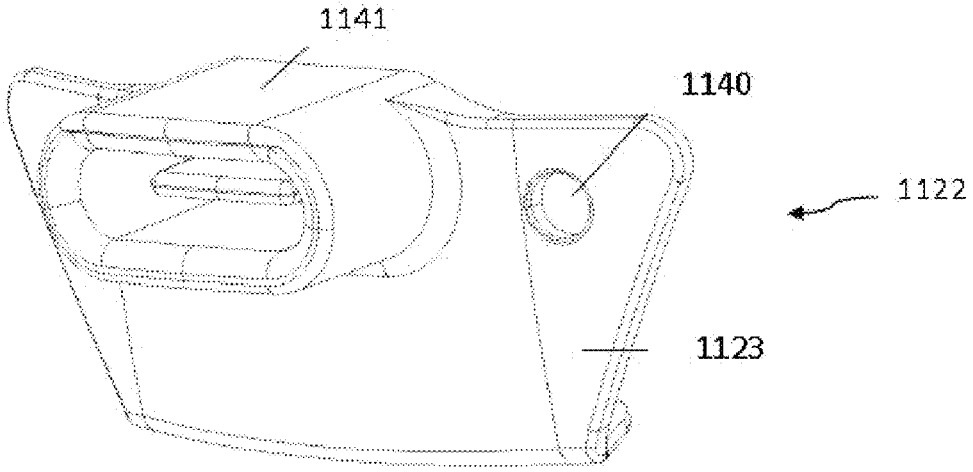
FIG. 12A shows a front perspective view of a back bumper of FIG. 11A for mounting a removable supplemental protection component on a forward portion of a helmet.
Figure 12B:
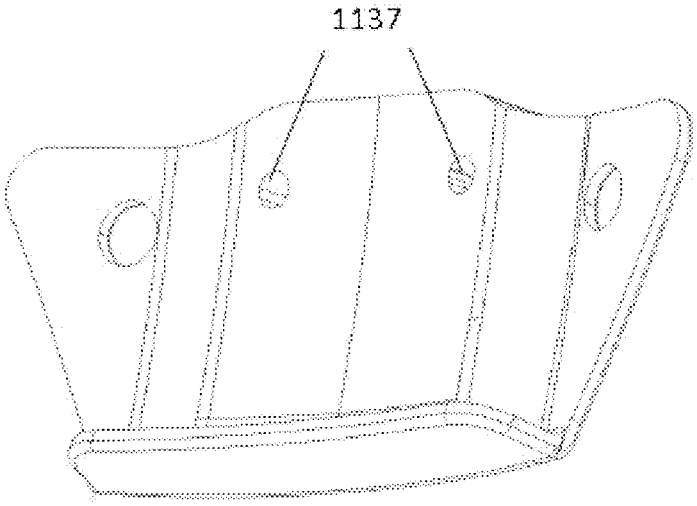
FIG. 12B shows a rear perspective view of the back bumper of FIG. 12A.
Figure 12C:
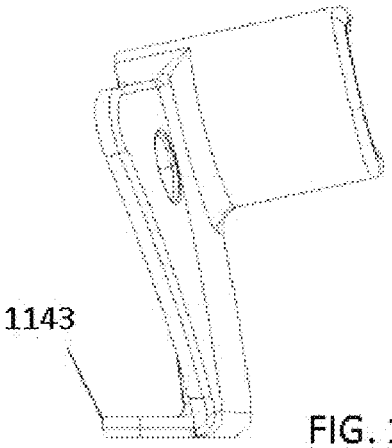
FIG. 12C shows a side view of the back bumper of FIG. 12A.
Figure 12D:
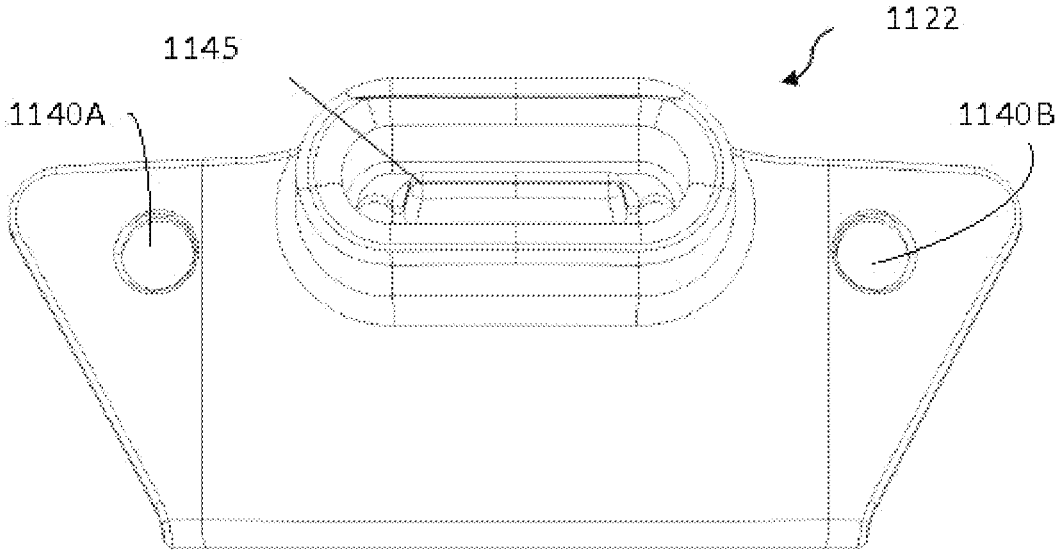
FIG. 12D shows a front view of the back bumper of FIG. 12A.
Figure 12E:
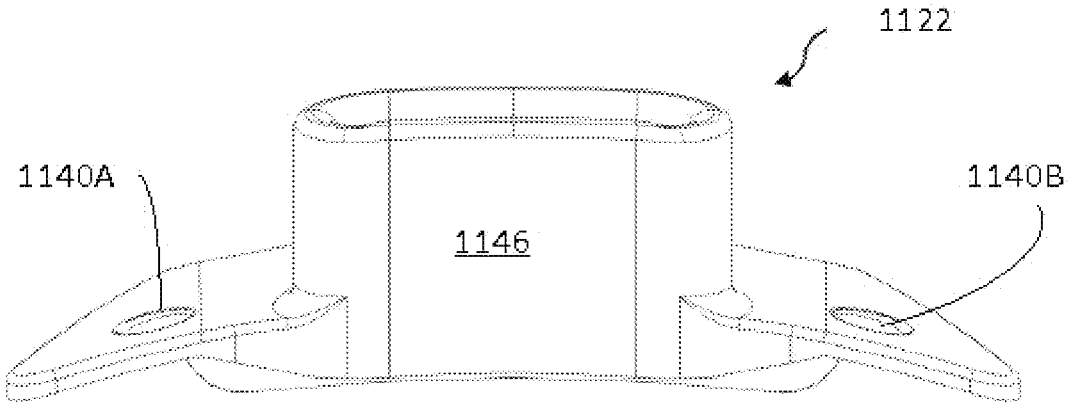
FIG. 12E shows a top view of the of FIG. 12A.
Figure 13A:
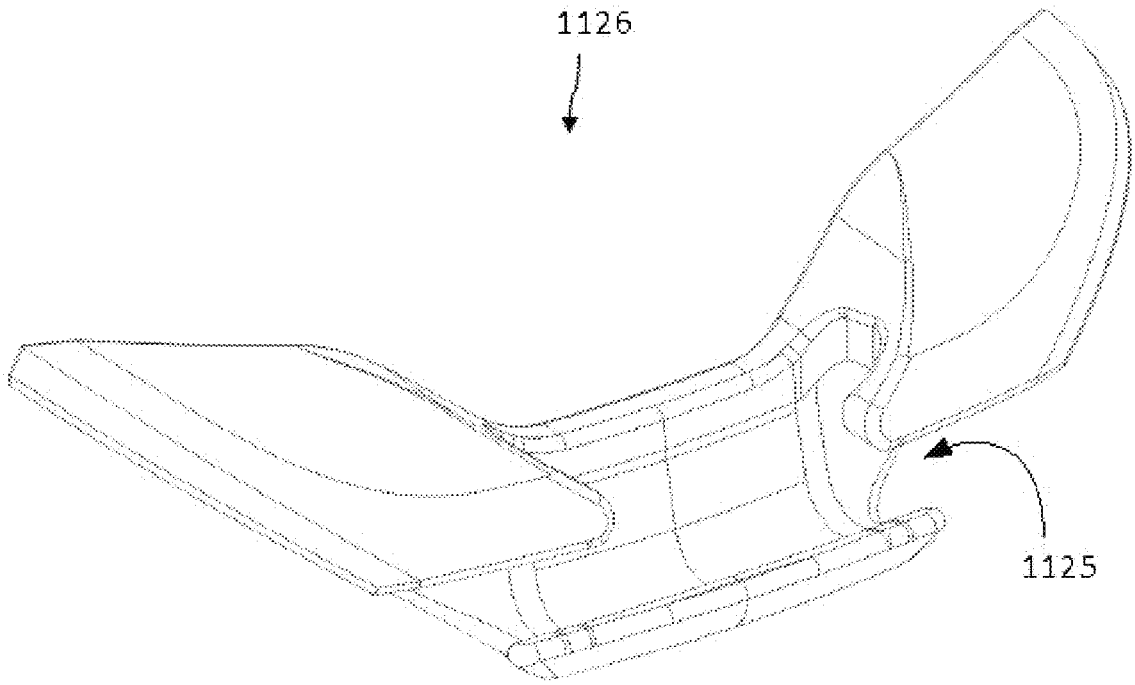
FIG. 13A shows a front perspective view of a facemask bumper of FIG. 11A for mounting a removable supplemental protection component on a forward portion of a helmet.
Figure 13B:
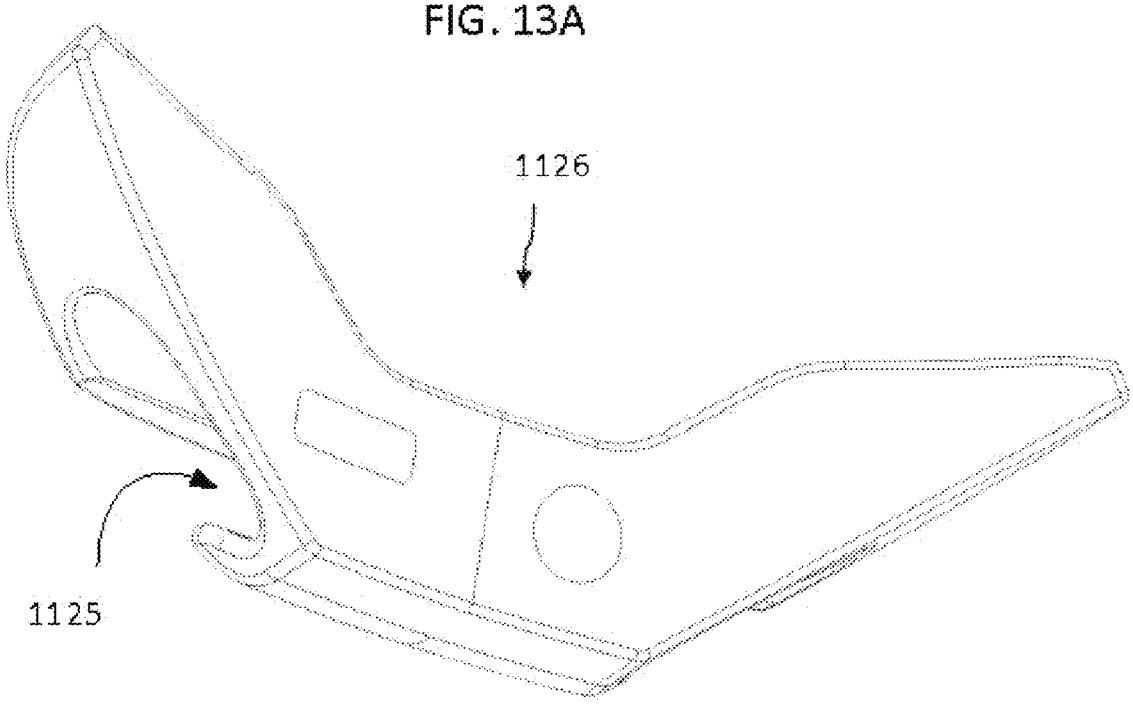
FIG. 13B shows a back perspective view of the facemask bumper of FIG. 13A.
Figure 13C:
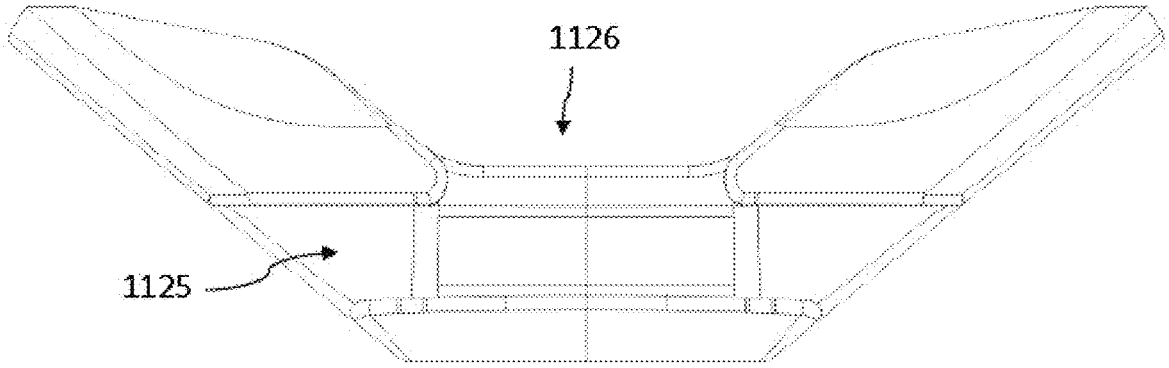
FIG. 13C shows a front view of the facemask bumper of FIG. 13A.
Figure 13D:
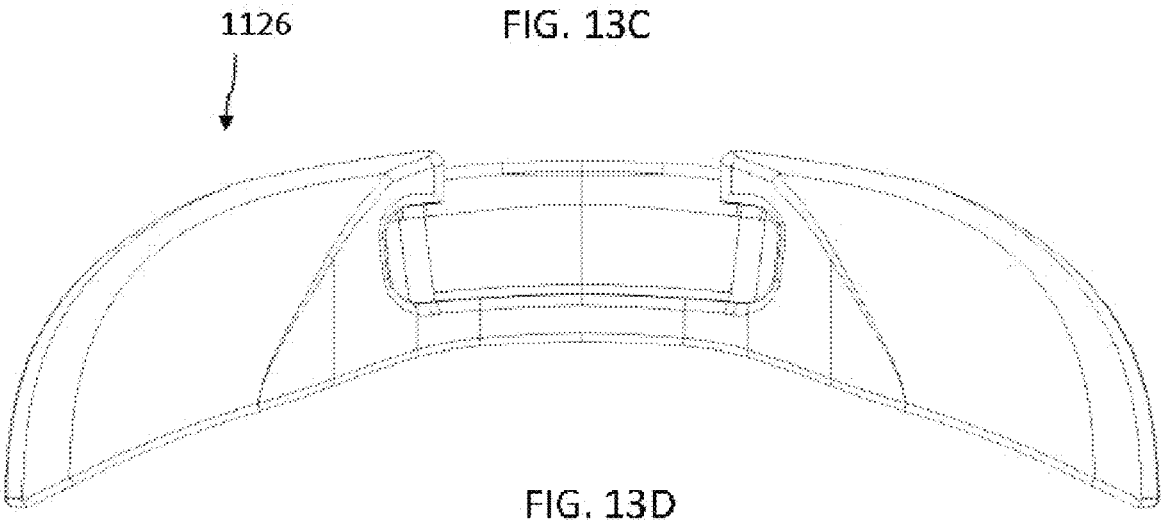
FIG. 13D shows a top view of the facemask bumper of FIG. 13A.
Figure 13E:
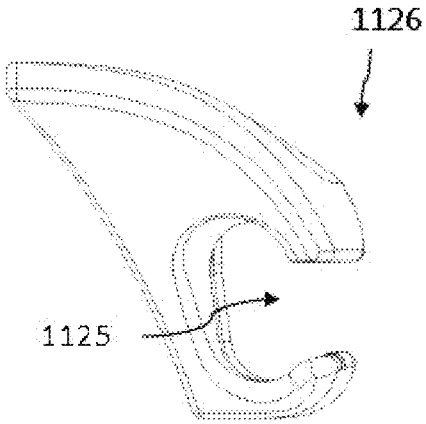
FIG. 13E shows a side view of the facemask bumper of FIG. 13A.
Figure 14A:
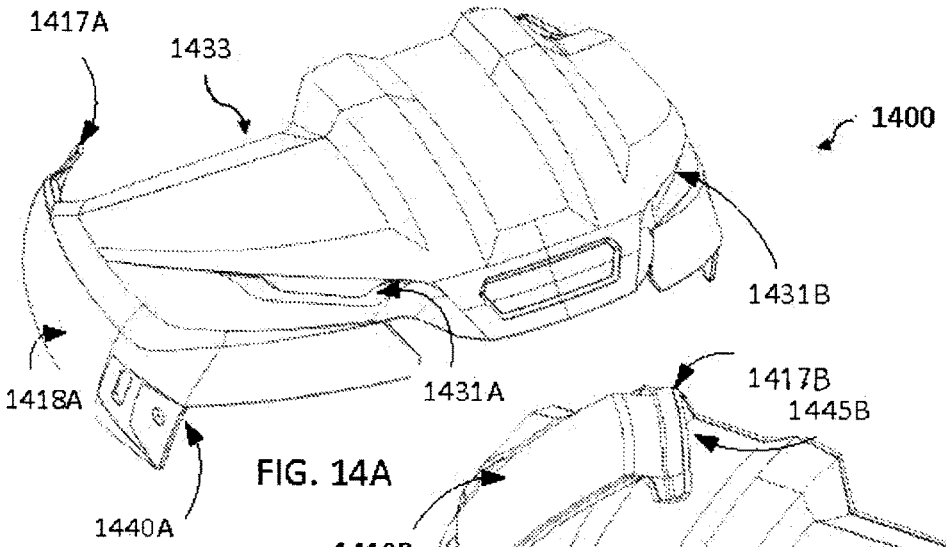
FIG. 14A shows a front perspective view of an example supplemental protection component.
Figure 14B:
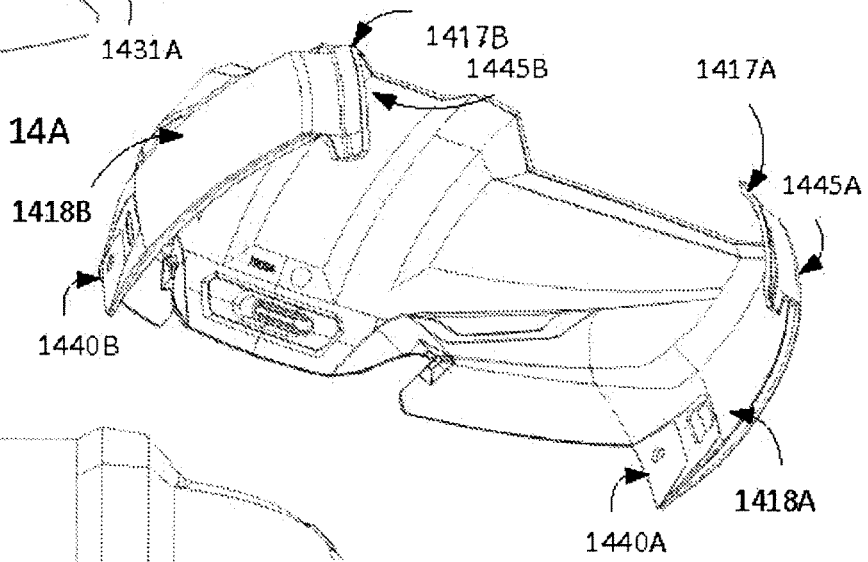
FIG. 14B shows a rear perspective view of the example component of FIG. 14A.
Figure 14C:
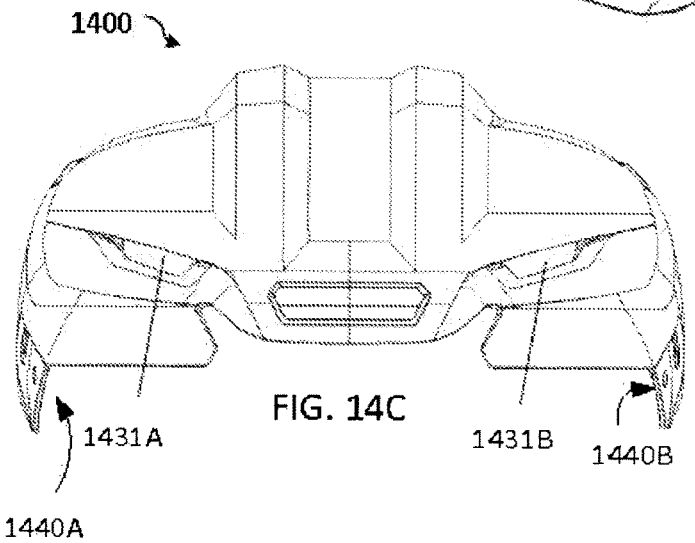
FIG. 14C shows a front view of the example component of FIG. 14A.
Figure 14D:
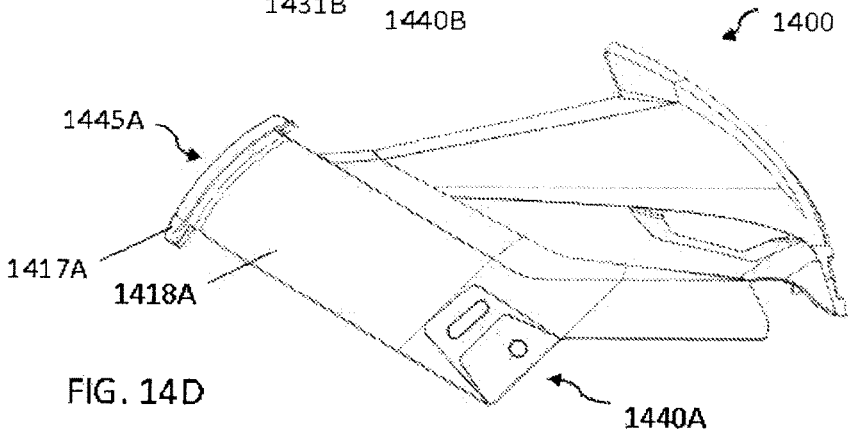
FIG. 14D shows a side view of the example component of FIG. 14A.
Figure 15A:
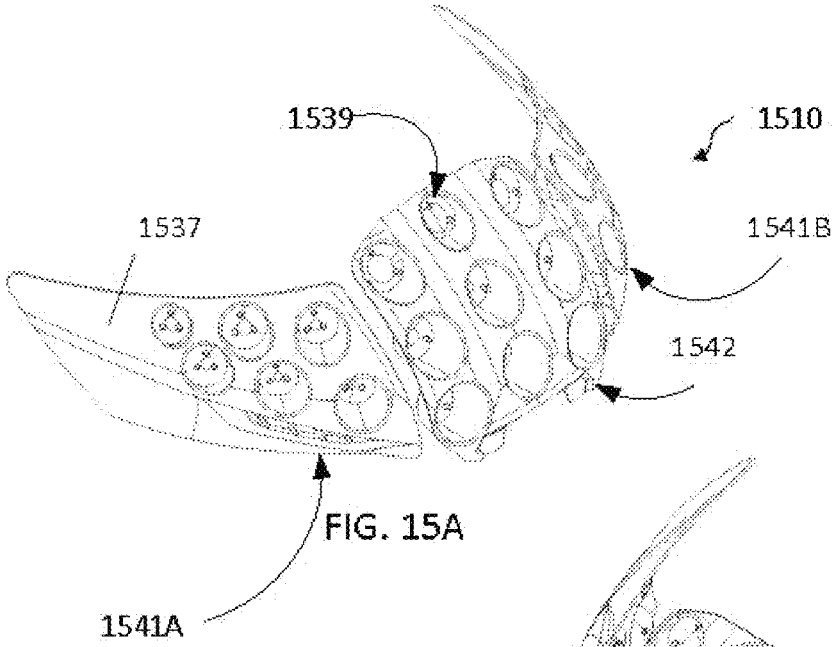
FIG. 15A shows a front perspective view of an example impact mitigation structure underlying a supplemental protection component.
Figure 15B:
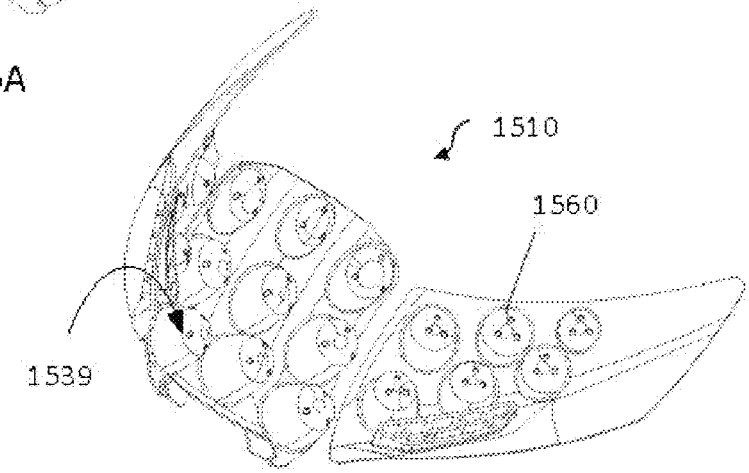
FIG. 15B shows a back perspective view of the example impact mitigation structure of FIG. 15A.
Figure 15C:
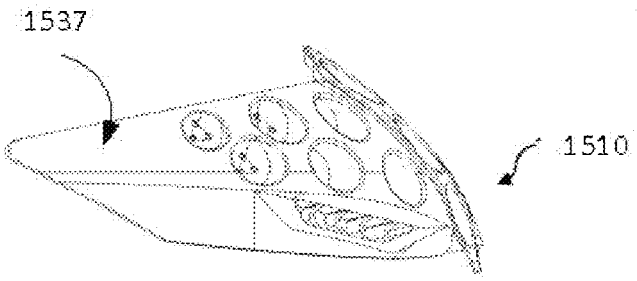
FIG. 15C shows a side view of the example impact mitigation structure of FIG. 15A.
Figure 15D:
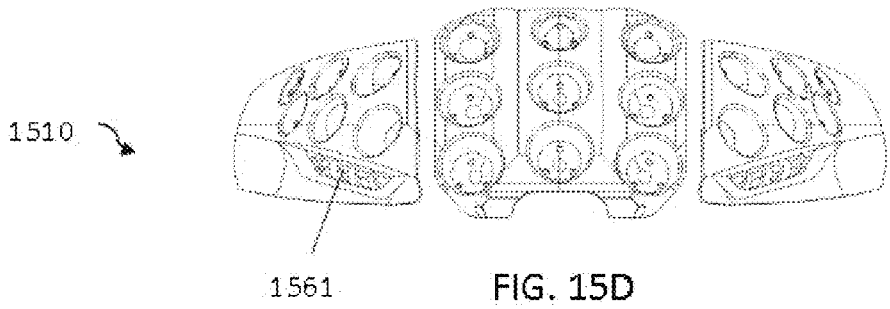
FIG. 15D shows a front view of the example impact mitigation structure of FIG. 15A.

In some implementations, no central bumper is required for connection of the supplemental protection component to the helmet. FIGS. 11A and 11B show an example bumper assembly 1100 for mounting a removable supplemental protection component on a forward portion of a helmet. The bumper assembly 1100 includes back bumper 1122 and facemask bumper 1126.

The bumper attachment assembly 1100 comprises a back bumper 1122 and a facemask bumper 1126. FIGS. 12A-E illustrate additional views of the back bumper 1122 alone. As shown in FIGS. 12A-E, the back bumper 1122 includes a front face plate 1123, connection plug 1141, fastening apertures 1140A and 1140B (jointly 1140), screw apertures 1137A and 1137B (jointly 1137), and fin 1143. The connection plug 1141 includes cavity 1145 and protrusion 1146.

The back bumper 1122 is coupled to the supplemental protection component, including the supplemental shell and/or the impact mitigation structure layer. The back bumper 1122 is further coupled to the helmet, including an internal surface of the helmet and/or an outer shell of the helmet. The back bumper 1122 couples to the facemask bumper 1126 by a variety of mechanisms, including by use of the connection plug 1141. In some implementations, the facemask bumper 1126 includes a protruding portion which fits into the cavity 1146 of the protrusion 1146 of the back bumper 1122, resulting in a friction fit between the back bumper 1122 and the facemask bumper 1126. Referring now to FIG. 11A, apertures 1137A and 1137B are also shown as well as studs 1139A and 1139B extending from a surface of the facemask bumper 1126 through fastening apertures 1140A and 1140B (jointly 1140) of the back bumper 1122, for attaching the back bumper 1122 and facemask bumper 1126 to the helmet. The apertures 1137A and 1137B allow screws or other fastening devices to pass through to connect the back bumper 1122 and facemask bumper 1126, as well as intervening structures such as the supplemental protection component or central bumper (not shown). Other fastening mechanisms may also be used to couple the back bumper 1122 and any of these structures.

FIGS. 13A-E show further views of the facemask bumper 1126. The facemask bumper 1126 comprises a channel 1125. The channel 1125 is sized and configured to receive a portion of a facemask (not shown). The facemask may rest within the channel 1125 and may further be clipped into place by a friction fit between one or more portions of the channel 1125, and/or by an additional portion of the facemask bumper 1126 which is screwed or otherwise fastened to the facemask bumper 1126 over a portion of the channel 1125. Though not shown in FIGS. 13A-E, the facemask bumper 1126 can include studs or a protruding portion designed to mate with the cavity 1145 of the connection plug 1141 of the back bumper 1122 to couple the facemask bumper to the back bumper 1122 and to the helmet. In some implementations, the protruding portion of the facemask bumper 1126 can be friction fir in the cavity 1145, or can include additional coupling mechanisms such as flanges to couple within the cavity 1145. In some implementations, the protruding portion is further coupled within the cavity 1145 by an adhesive. The bumper attachment assembly 1100 is coupled to the helmet and the supplemental protection component. The bumper attachment assembly 1100 comprises a metal or a polymer material. The polymer material may comprise elastic or viscoelastic properties. The elasticity may facilitate independent action from the helmet and to absorb forces rather than transferring the forces to the attached helmet or having the bumper attachment assembly 1100 fail.

FIGS. 14A-D show an example supplemental protection component 1400. The supplemental protection component 1400 includes supplemental shell 1408, rear edge 1433, side panels 1418A and 1418B fashioned as rearward-extending wings, each having a fastening tab 1417A and 1417B at a rearward edge 1445A and 1445B, and forward vents 1431A and 1431B. In some implementations, the supplemental protection component 1400 includes a first surface, a second surface, and one or more vents including forward vents 1431A and 1431B. In some implementations, at least a portion of the first surface or second surface of the supplemental protection component 1400 can be shaped or configured to substantially match and/or match a portion of a commercially available helmet. In some implementations, at least a portion of the first surface or a second surface of the supplemental protection component 1400 can be shaped or configured to substantially match and/or match a portion of the outer surface or external surface of the outer shell of a commercially available helmet. In some implementations, the first surface and/or second surface of the supplemental protection component 1400 can further be shaped and/or configured to receive the supplemental impact mitigation structure (not shown), with the supplemental impact mitigation structure optionally removably coupled or permanently coupled to the first and/or second surface of the supplemental protection component 1400.

The base membrane or supplemental shell of the of the supplemental protection component 1400 includes forward vents 1431A and 1431B, and may include additional vents.

The forward vents 1431A and 1431B may be through-holes that extend through the first and second surface of the supplemental protection component 1400, including one or both of the supplemental shell and underlying supplemental impact mitigation layer. The forward vents 1431A and 1431B may be concentrically aligned with the vents of a commercially available helmet (not shown) to allow continuous airflow through the helmet assembly when the supplemental protection component 1400 is attached to the helmet. The supplemental protection component 1400 may further comprise attachment posts (not shown) to facilitate the attachment to the commercially available helmet, for example studs or other projections that can fit into or through one or more vents or connection points of a helmet. Furthermore, the supplemental protection component 1400 may comprise various decorative features to match or complement the underlying helmet, for example, a central portion and a side portion, with the central portion having a raised surface relative to the side portion.

In some implementations, the supplemental shell of the supplemental protection component 1400 includes side panels 1418A and 1418B (jointly 1418). The multiple side panels 1418 are positioned on the right and left side portion of the supplemental shell. At least a portion of the multiple side panels 1418 matches or substantially matches the contours of the helmet and/or the external surface of the outer shell. The multiple side panels 1418 comprise a first end 1440A, 1440B (jointly 1440) and a second end 1445A, 1445B (jointly 1445). The second end 1445 of the multiple side panels 1418 comprises multiple tabs 1417A and 1417B (jointly 1417). The multiple tabs 1417 extends perpendicularly and/or obliquely to or from the second end 1445 and the multiple tabs 1417 is wider than a width of the multiple side panels 1418. The multiple tabs 1450 is shaped and configured to be disposed within elongated side vents of the outer shell of an underlying helmet (not shown). The multiple tabs 1450 are flexed to be inserted into the vent, and expanded once the multiple tabs 1450 are secured within the elongated side vents. The first end 1440 of the multiple side panels 1418 may comprise a recess. The recess includes one or more holes. The one or more holes are aligned with the one or more holes on the helmet and/or the outer shell. The one or more holes may be concentric with the one or more holes on the helmet and/or the outer shell.

FIGS. 15A-D show a supplemental impact mitigation structure 1510 designed to fit within a supplemental protection component, such as supplemental protection component 1406 of FIG. 14. The supplemental impact mitigation structure 1510 can be coupled to the first or second surface of the supplemental shell, for example by bonding, adhesive, or a releasable or permanent fastener. The supplemental impact mitigation structure 1510 includes multiple impact mitigation structures 1539. The multiple impact mitigation structures 1539 are shown in greater detail in FIGS. 16A-C.

Figure 16A:
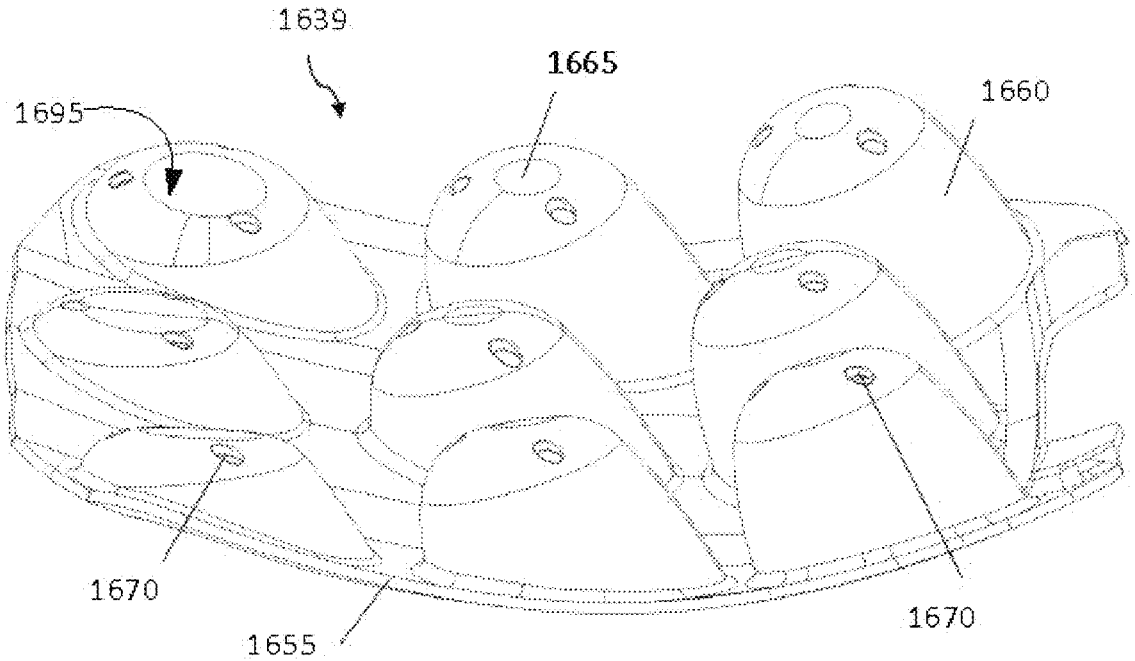
FIG. 16A shows an example impact mitigation structure for use in a supplemental protection portion.
Figure 16B:
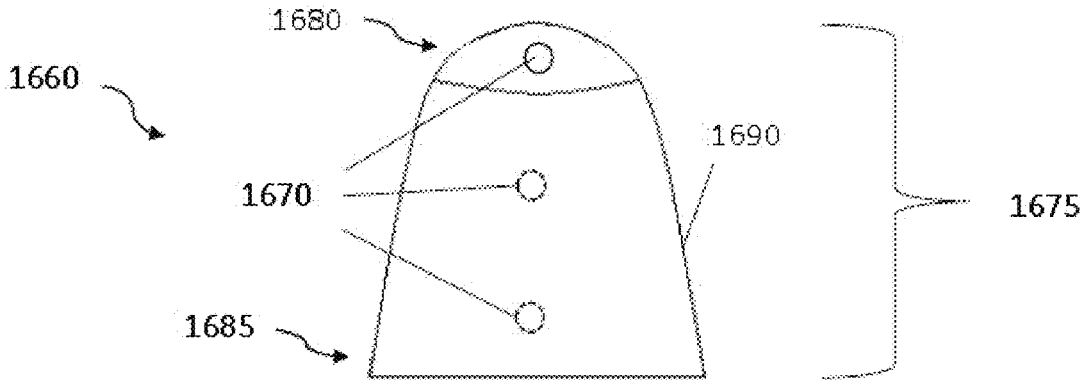
FIG. 16B shows an example of a single dome structure from the example impact mitigation structure of FIG. 16A.
Figure 16C:
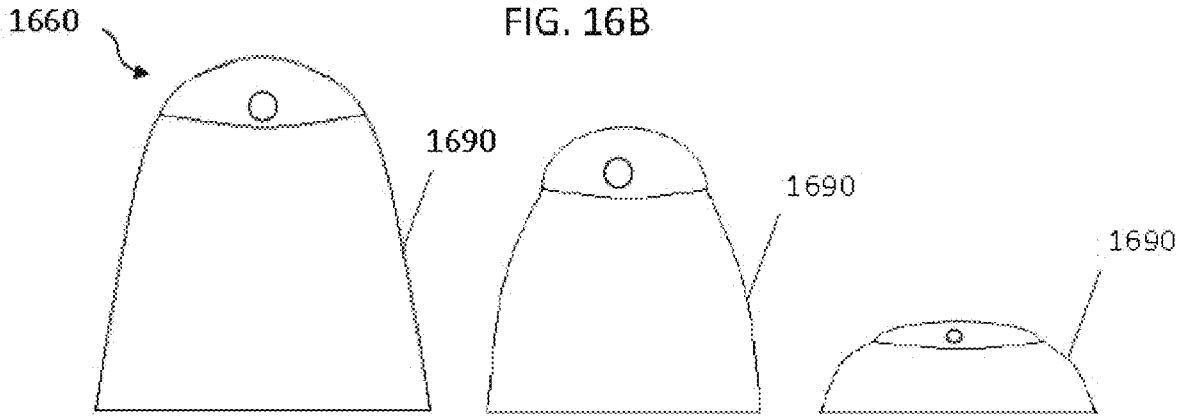
FIG. 16C shows an example of a single dome structure from the example impact mitigation structure of FIG. 16A at various points during an impact.
Figure 17A:
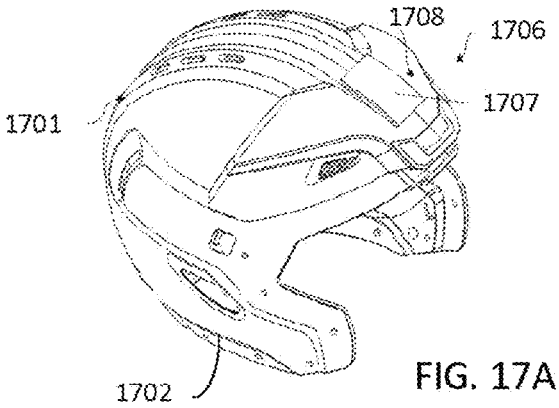
FIG. 17A shows an example helmet including an example second supplemental protection mechanism.
Figure 17D:
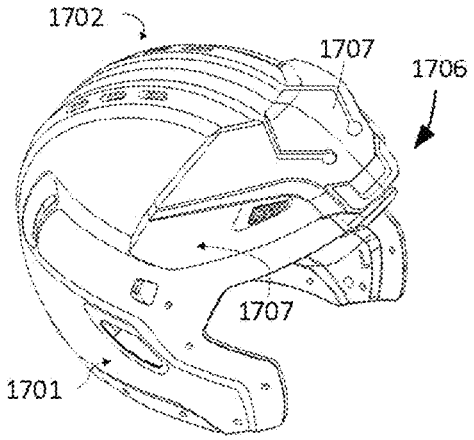
FIG. 17D shows an example helmet including another example second supplemental protection mechanism.
Figure 17B:
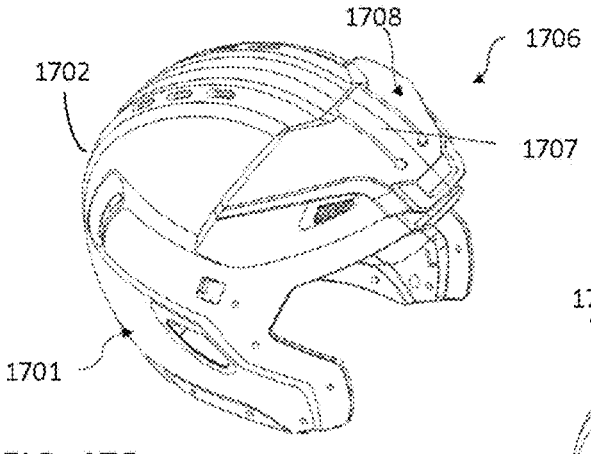
FIG. 17B shows an example helmet including another example second supplemental protection mechanism.
Figure 17E:
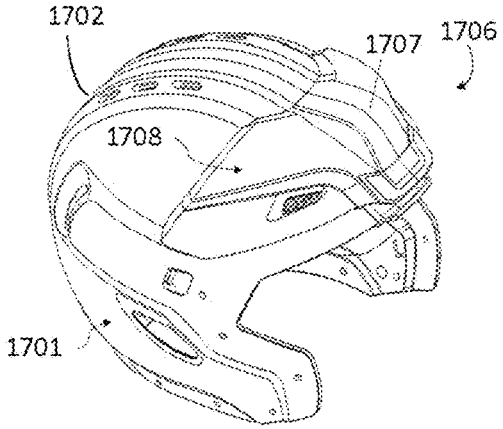
FIG. 17E shows an example helmet including another example second supplemental protection mechanism.
Figure 17C:
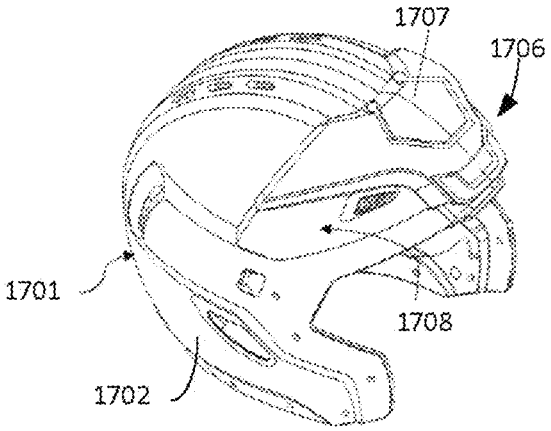
FIG. 17C shows an example helmet including another example second supplemental protection mechanism.

Referring now to FIGS. 16A-C, the multiple impact mitigation structures 1639 are formed as elongated dome structures 1660. The multiple impact mitigation structures 1639 can include a base layer 1655. The elongated dome structures 1660 extend upwardly and/or obliquely from a top surface of the base layer 1655. A back surface of the base layer 1655 mates with or is coupled to the internal surface of the supplemental shell. The mating or coupling may include a seal that traps gas or air within the interior of the elongated dome structures 1660. The elongated dome structures 1660 including a top end 1680 and a bottom end 1685. The top end 1680 comprising a flat or planar surface 1665 or a substantially flat or substantially planar surface 1665. At least a portion of the flat or substantially flat surface 1665 contacts the external surface of the outer shell of the underlying helmet shell.

The impact mitigation structures comprising elongated dome structures 1660 are designed to hold air within an internal cavity 1695. During an impact, the multiple impact mitigation structures 1639 comprising elongated dome structures 1660 deform outwardly in a circumferential pattern or deform axisymmetrically outward during an impact (see FIG. 16C), which acts like a piston-oriented system that the deformation forces compressed air to be released through multiple holes that are positioned around the elongated dome structure 1660. The controlled released air behaves similar to a strain-rate dependent material, which the multiple holes controls the volume of escaped air, thus, if the rate of the impact is high, the elongated dome structure 1660 becomes stiffer and if the rate of the impact is low, the elongated structure 1660 becomes less stiff (e.g. using the power of a compressed gas, such as air, to produce a force. Once the impact is removed, the internal cavity 1695 reinflates by drawing air back into the internal cavity 1695 of the elongated dome structures 1660, and returns to its original configuration. In some implementations, the elongated dome structures 1660 are formed as a continuous dome structure 1660 without a cavity, and the material is designed to expel air within the material when impacted.

The base layer or membrane 1655 comprises a first material, the elongated dome structure 1650 comprises a second material. The base layer 1655 may be formed of a same or different material than the elongated dome structure 1660. The first material of the base layer 1655 and/or the second material elongated dome structure 1660 may comprise a flexible polymer and/or foam. The flexible polymer includes a thermoplastic elastomer, a thermoset elastomer, an elastic material, a foam material, and/or any combination thereof. The first material of the base layer 1655 and/or the second material of the elongated dome structures 1660 may include a rigid polymer and/or foam. The first material and/or second material may allow local deformation, which may affect a subset of the elongated dome structures 1660 and the surrounding elongated dome structures 1660. Accordingly, the material may allow for vibratory dampening or dissipate the impact energy through deformation, reducing the impact force or stress that gets transmitted. The material of the base layer 1655 and/or the material elongated dome structure 1660 may comprise polyurethane.

The elongated dome structures 1660 extends from the base layer or base membrane 1655 and/or extends from a top surface of the base layer or membrane 1655. Alternatively, the elongated dome structure 1660 extend from the base layer 1655 perpendicularly, substantially perpendicular, and/or obliquely from the base layer or membrane 1655. Accordingly, the elongated dome structure 1660 may extend normal to the plane of curvature of the base layer 1655. The elongated dome structure 1660 is hollow forming an internal cavity 1695, comprising a volume.

The elongated dome structure 1660 comprises a height 1675, a first end 1680, a second end 1685, and a body 1690. The elongated dome structures 1660 comprises a rounded frustum shaped cone or elongated dome. The first end 1680 of the elongated dome structure 1660 may comprise a hemispherical shape, an arch shape or an arc shape and/or a dome shape. The first end 1680 further comprises a surface 1665, the surface 1665 may be planar or substantially planar to contact the external surface of an outer shell. The surface 1665 will provide some additional friction against the external surface of the outer shell to prevent sliding or reduce the amount of sliding of the first end 1680 along the external surface of the outer shell. The first end 1680 will further comprise multiple holes 1670 that are spaced apart in a circumferential manner. Alternatively, the second end 1685 may comprise multiple holes 1670 that are spaced apart in a circumferential manner or circumferentially. Accordingly, the multiple holes 1670 may be disposed between the first end 1680 and the second end 1685. The spaced apart may be symmetrical or non-symmetrical. The spaced apart may be uniform or non-uniform. The multiple holes 1670 may comprise a shape. The shape may include a circle, an oval, an ellipse, a regular polygon, an irregular polygon, and/or any combination thereof. The multiple holes 1670 are sized and configured to release and control air flow from the internal cavity 1695 of the elongated dome structures 1660 and/or also facilitate return of the air into the internal cavity 1695.

The body 1690 comprises sidewalls that define a curvature or a radius. The height 1675 of the elongated dome structures 1660 may vary and/or the body 1690 may vary. The body 1690 sidewalls are radiused, as they get shorter or the height decreases, the body 1640 sidewalls radius increases. In some implementations, the elongated dome structures 1660 follow the arch or dome principle. As the axial compressive force is thrust downwards, the horizontal thrust pushes the body 1690 sidewalls outwards. Therefore, if the height 1675 of the elongated dome structure 1660 decreases, the outward thrust increases, and as a result, preventing the arch from collapsing and bottoming out.

The elongated dome structures 1660 may comprise an impact performance characteristic. The impact performance characteristic may be desirably customized to the number or player-specific factors discussed above. The impact performance characteristic may include reduction of peak impact force, reduction of the acceleration, strain rate dependent deformation, and/or any combination thereof. In some implementations, the elongated dome structures 1660 may comprise a shape and configuration with strain rate dependency (e.g. the deformation of the material depends on the rate at which loads are applied).

Referring again to FIGS. 15A-D, the supplemental impact mitigation structure 1510 may have multiple portions, such as a center portion 1542, and two side portions 1541A and 1541B. The multiple impact mitigation structures 1539 may be the same or different on the center portion 1542 as on the two side portions 1541A and 1541B. In some implementations, a different shape, size, scale, material or pattern of the multiple impact mitigation structures 1539 is implemented in the center portion 1542 than on the two side portions 1541A and 1541B of the supplemental impact mitigation structure 1510. In some implementations, the shape, size, scale, material or pattern of the multiple impact mitigation structures 1539 is the same on the center portion 1542 as on the two side portions 1541A and 1541B of the supplemental impact mitigation structure 1510.

In some implementations, a size, shape, height, or scale of the multiple impact mitigation structures 1539 varies across a region of the supplemental impact mitigation structure 1510. For example, in FIG. 15B, the multiple impact mitigation structures 1539 closes to a front edge of the supplemental impact mitigation structure 1510 extend further orthogonally from a surface of the supplemental impact mitigation structure 1510 than the multiple impact mitigation structures 1539 nearest a back edge of the supplemental impact mitigation structure 1510. The difference in shape, size, position, pattern, or orientation of the multiple impact mitigation structures 1539 can serve to better match an external contour of the underlying helmet, or can serve to provide enhanced impact protection in certain regions of the supplemental impact mitigation structure 1510. For example, a subset of the multiple impact mitigation structures 1539 can be formed of a less rigid material to enhance impact protection in the region of the subset of structures, or can comprise more rigid material to facilitate attachment of the supplemental impact mitigation structure 1510 to the commercially available helmet or supplemental shell.

Though the supplemental impact mitigation structure of 1510 is depicted as having multiple impact mitigation structures 1539 formed as elongated dome or dome-shaped structures 1660 as described in FIGS. 16A-C, in some implementations, the supplemental impact mitigation structure 1510 includes other mitigation structures as described herein. Such impact mitigation structures can include one or more of filament structures, laterally supported filament structures, auxetic structures, columnar structures, polygonal structures, vertical structures, foam structures, undulating structures (e.g., zig-zag structures), chevron structures, herringbone structures, and/or any combination thereof. The impact mitigation structures can provide a response to impact on the helmet which is different than an impact response of the mitigation layers within the helmet, providing, for example, a first impact response to an impact and the helmet mitigation layers providing a second impact response.

Additional supplemental protection components formed as cantilevered shell sections can be used in place of or in combination with the supplemental protection components described herein. In some implementations, the cantilevered shell sections can provide a third impact response different from the impact responses of the impact mitigation layer of the supplemental protection component and the helmet itself. FIGS. 17A-E show helmets including various second supplemental protection mechanisms formed as cantilevered sections of supplemental shells to the helmet. Each of FIGS. 17A-E shows a helmet system 1700 including a helmet 1701 having an outer shell 1702, a supplemental protection component 1706 having a supplemental shell 1708, and a cantilevered section (also referred to herein as a collapsible section or member) 1707 of the supplemental shell. Although not shown, the first supplemental protection component 1706 can also include any of the impact mitigation structures described herein.

The supplemental protection component 1706 includes a collapsible member 1707. The impact absorption of the collapsible member 1707 may be the same at adjacent portions of the supplemental protection component 1706 or it may be different. The collapsible member 1707 may include a cantilevered flap that is disposed on at least one surface of the supplemental protection component 1706, for example on the supplemental shell 1708. The collapsible member 1707 may be disposed on a front portion of the supplemental protection component 1706 and/or disposed on a central portion of the supplemental shell 1708 of the supplemental protection component 1706. Alternatively, the collapsible member 1707 may be disposed on the side portions, central portions, frontal portion and/or any combination thereof.

The collapsible member 1707 comprising a cantilevered flap may include an empty gap or spacing that surrounds a portion of the collapsible member 1707 to define its boundaries. The empty gap or spacing may comprise removed material to allow the cantilevered flap to flex differently than adjacent portions of the supplemental protection component 1706. The collapsible member 1707 comprising a cantilevered flap may further include a first end and a second end, the first end comprising a base, and the second end being a free end to behave similar to a cantilevered structure or living hinge. The first end may be integrally formed with the supplemental protection component 1706. Alternatively, the first end may be affixed as a separate component to the supplemental protection component 1706. The first end may be disposed or positioned at the bottom edge and/or adjacent to the bottom edge of the supplemental protection component 1706, and the second end disposed or positioned at the top edge and/or adjacent to the top edge of the supplemental protection component 1706. Alternatively, The first end may be disposed or positioned at the top edge and/or adjacent to the top edge of the supplemental protection component 1706, and the second end disposed or positioned at the bottom edge and/or adjacent to the bottom edge of the supplemental protection component 1706. In other implementations, the first or second end may extend beyond the bottom edge or the top edge of the supplemental impact protection element.

The neutral and non-flexed position of the collapsible member 1707 may comprise at least one surface of the first end and the second end flush with (e.g. following the contours of) the supplemental protection component 1706. Alternatively, the neutral position of the collapsible member 1707 may comprise at least one surface of the second end or second end raised with the adjacent central portion and/or the side portion of the supplemental protection component 1706. Accordingly, the neutral position of the collapsible member 1707 may comprise the at least one surface of the first end or the second end below (e.g. follows contours) the adjacent central portion and/or the side portion of the supplemental protection component 1706.

The collapsible member 1707 can have a variety of shapes, as illustrated in FIGS. 17A-E. The shape may be a circle, an oval, a regular polygon and/or an irregular polygon. For example, the polygon shape may include multiple line segments forming the shape. The multiple line segments intersects to form a closed polygonal chain or polygonal circuit. The line segments comprise straight line segments or curvilinear line segments. The intersections of the multiple line segments may include a relief strain, the relief strain comprises a shape. The relief strain shape may comprise a circular, oval or elliptical shape, and/or any shape known in the art that suffices to relieve strain at the intersections. The collapsible member 1707 also has a height and a width. The height may be at least ¼ smaller than the width of the central portion of the supplemental impact protective assembly and/or the supplemental impact protective element, and at least ¼ smaller than the width of the central portion of the supplemental impact protective assembly and/or the supplemental impact protective element. Accordingly, the height may comprise a range between 0.25 in to 3.5 inches, and the width may comprise 0.25 in to 2.75 inches.

In some implementations, the collapsible member 1707 is formed of a material. The collapsible member material may be the same material as the adjacent portions of the supplemental protection component 1706. Alternatively, the collapsible member material may be a different material as the adjacent portions of the supplemental protection component 1706. The collapsible member 1707 may comprise a different compression strength than the adjacent portions of the supplemental protection component 1706. Alternatively, the collapsible member 1707 may comprise the same compression strength than the adjacent portions of the supplemental protection component 1706 or outer shell 1702 of the helmet 1701.

As described above, the supplemental protection component 1706 may be coupled to at least a portion of the one or more specific regions of the helmet 1701 and/or outer shell 1702. The regions may comprise a frontal region (or front), an occipital region (or lower-back), a mid-back region, a parietal region (or midline), and a temporal region (right and/or left sides), the orbit region, the mandible (front, right and/or left side) region, the maxilla region, the nasal region, zygomatic region, the ethmoid region, the lacrimal region, the sphenoid region and/or any combination(s) thereof. The supplemental protection component 1706 may comprise at least a portion of one surface that matches or substantially matches the contours of the outer shell 1702 of the helmet 1701 within or adjacent to the position-specific region.

As illustrated in FIGS. 17A-E, the supplemental protection component 1706 can be designed and/or engineered to have different independent and localized impact responses to the impact forces occurring while playing a sport and/or an occupation. In other words, the helmet may include a first impact response, the supplemental impact protection element may include a second impact response, and the collapsible member may include a third impact response. The first, second and third impact response may be different, and/or they may be different. Accordingly, the first and second impact response may comprise the same impact response or a different impact response. The second and third impact response may comprise the same impact response or a different impact response. Lastly, the first and third impact response may comprise the same impact response or a different impact response. Furthermore, the collapsible member moves relative at least one surface of the supplemental impact protection element. The collapsible member moves relative to a portion of the central portion, and the side portions of the supplemental impact protective element.

Figure 18:
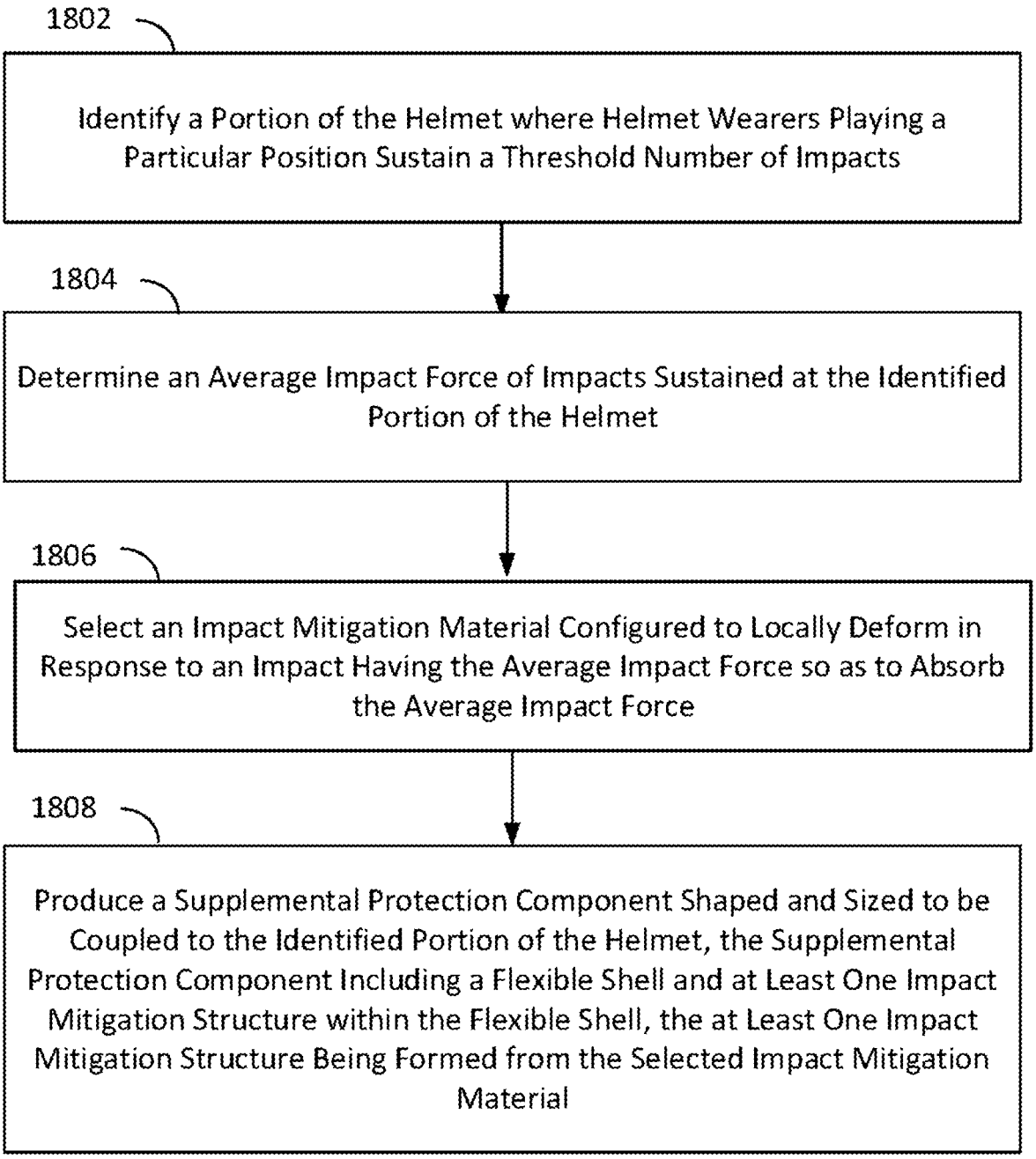
FIG. 18 shows a flow chart of a method of producing a supplemental protection component for use on a region of a helmet.

FIG. 18 shows a flow chart of a method 1800 of producing a supplemental protection component for use on a region of a helmet, for example any of the supplemental protection components described above in FIGS. 1A-B, 2A-B, 3-6, 7A-C, 8A-D, 9, 14A-D, 15A-D, and 17A-E, permanently or removably coupled to the helmet or attached by any of the connector mechanisms described above (such as connectors of FIGS. 10A-E, 11A-B, 12A-E, and 13A-E).

At step 1802, a portion of the helmet where helmet wearers playing a particular position sustain a threshold number of impacts is identified. For example, this portion can be identified from video or sensor data for a particular player or for multiple players in a particular position, such as linebacker, quarterback, or other position. Step 1802 can include collecting player performance data for the player, the player performance data comprising data regarding a series of impact events occurring to the protective helmet of the player, and analyzing the player performance data to determine at least one position-specific region on the protective helmet where a majority of the series of impacts events occur Prior to the step of identifying the portion of the helmet, the particular position requiring additional protection can be identified based on video or sensor data and a ranking of various risk factors. The method of initial ranking may comprise the steps of including and/or ranking one or more primary factors and/or impact zones, along with various combinations of less-frequent secondary factors and/or impact zones. Subsequently, the ranking can further include even less frequent tertiary factors and/or impact zones, quaternary factors and/or impact zones, and so on. In such cases, it is possible to improve the impact performance of a given helmet or other new protective structure helmet designs in a specific manner to accommodate the most frequent and/or most devastating types of injuries for a particular player and/or player position. In various implementations, such "improvements" could include features that might improve, degrade and/or not affect helmet performance against other less-frequent impact types and/or impact zones, as described herein.

At step 1804, an average impact force of the impacts sustained at the identified portion of the helmet are determined. The average impact force can be determined by sensors implemented in the helmets of players in the target position, or can be estimated based on other data such as video data. The average impact force of the impacts can provide guidance about the required protections to mitigation risk factors associated with the types of impacts experienced. The average velocity of the average impact experienced can provide guidance as to the design of protective components. For example, the required offset and compression characteristics of the material forming the component will need to efficiently absorb or mitigate impacts of the average velocity without "bottoming out" and passing the impact velocity to the helmet wearer's head. In some implementations, the average impact has a velocity between about 3 m/s and 10 m/s. In some implementations, the average impact velocity is about 15 m/s. In some implementations, the average impact velocity is less than 3 m/s. In some implementations, the average impact velocity is greater than 15 m/s.

At step 1806, an impact mitigation material is selected which is configured to locally deform in response to an impact having the determined average impact force so as to absorb the average impact force. The impact mitigation material must be selected so as to compress nearly the full extent of its offset, or its thickness, upon impact to absorb the determined average impact force without passing on the velocity of the impact to the wearer's head. The impact mitigation material can be selected from a table of materials based on the deformation response, stiffness, and other material properties of the material. In some implementations, the impact mitigation material can be selected by a computer program based on the material characteristics and properties. In some implementations, the impact mitigation material can be selected based not only on material characteristics and properties of the material and the average impacts to be protected against, but also based on properties or characteristics of the helmet to which the impact protection component is designed to be attached.

The material can be a foam, a polyurethane foam, an ethylene foam, a 3D printed lattice, a polyethylene foam, a polystyrene foam, a polypropylene foam, or any other suitable material. The material is optimized to protect the wearer of the helmet from impacts having the velocity and force determined in step 1804. In some implementations, the material is an engineered material, for example, an injection molded material comprising multiple impact mitigation structures.

In some implementations, the selection of the material further includes the design or engineering of a new material or structure 'tuned' to absorb the average impact force. The selection of the material includes the determination of an appropriate material stiffness tuned to the average impact force. The selection of the material can further include the selection of a type, shape, or design of an impact mitigation structure, and additionally or alternatively, the determination of an appropriate thickness (or offset) of the layer or structure. The thickness should allow for local compression in response to the average impact force that compresses the layer or structure fully without allowing a covering supplemental shell to contact an underlying outer shell of the helmet. If the material were to deform to allow contact between the supplemental shell and the outer shell of the helmet (i.e., "bottom out"), the average impact force would be passed on to the wearer rather than absorbed by the supplemental protection component.

In some implementations, the impact mitigation structures are formed as one of flexible domed structures, flexible polygonal structures, flexible vertical structures, foam structures, undulating structures, laterally supported filament structures, auxetic structures, or 3D printed lattice structures.

At step 1808, a supplemental protection component is produced. The supplemental protection component is shaped and sized to be coupled to the identified portion of the helmet. The supplemental protection component includes a flexible shell and at least one impact mitigation structure within the flexible shell. The at least one impact mitigation structure is formed from the selected impact mitigation material.

In some implementations, the at least one impact mitigation structure is adhered or bonded to the flexible shell. In other implementations, the at least one impact mitigation structure is removably coupled to the flexible shell. In some implementations, the supplemental protection component includes fasteners or connectors to allow coupling of the supplemental protection component to a helmet. In some implementations, the supplemental protection component includes fasteners or connectors to allow coupling of additional components, such as visors, chinstraps, or facemasks to the supplemental protection component and helmet.

In some implementations, the impact mitigation material is selected and created based on the average impact force. In some implementations, both the material and the type of impact mitigation structure are selected and produced for the purpose of producing the supplemental protection component. In some implementations, multiple layers of impact mitigation materials are positioned in the supplemental protection component. In some implementations, a stiffness of the impact mitigation structures is different than a stiffness of impact mitigation layers in the helmet to which the supplemental protection component is coupled. In some implementations, the impact mitigation structures have a stiffness 20% greater than a stiffness of impact mitigation layers in the helmet. In some implementations, the impact mitigation layers in the helmet have a stiffness 20% greater than a stiffness of the impact mitigation structures. In some implementations, by utilizing a less stiff (i.e., softer) impact mitigation structure in the supplemental protection component, a first impact response of the impact mitigation structure absorbs all or a majority of the average impact force.

In some implementations, the flexible shell of the supplemental protection component is formed of a flexible material, which is the same or different than a material forming the outer shell of the helmet. In some implementations, the flexible shell of the supplemental protection component can be locally deformed in response to an impact on the supplemental protection component such that the flexible shell bends or deforms toward the outer shell of the helmet, but does not contact the outer shell of the helmet. The underlying impact mitigation structures may move, compress, expel fluid, or use any other mechanism to cushion the flexible shell and to slow the deformation.

In some implementations, the manufacture of a position-specific helmet may further comprise the steps of securing the supplemental protection component to the protective helmet in proximity to the at least one identified portion. This can include attaching the supplemental protection component to an outer surface of the protective helmet at least partially over the at least one identified portion. While the supplemental protection components illustrated and discussed herein are coupled to an outer shell of the helmet, it is contemplated that the manufacture of a position-specific protective helmet can further include attaching a supplemental protection component to an inner surface of the protective helmet at least partially under the at least one identified portion, and/or replacing at least a portion of an existing impact protection layer of the protective helmet in proximity to the at least one identified portion. In some implementations, the step of securing the supplemental protection component to the protective helmet in proximity to the at least one identified portion comprises creating an additional opening in at least a portion of the protective helmet and securing at least a portion of the supplemental protection component to the protective helmet using the additional opening. In some implementations, securing the supplemental protection component to the protective helmet in proximity to the at least one identified portion comprises attaching the supplemental protection component to the protective helmet without substantially altering the protective helmet.

While this specification contains many specific implementation details, these should not be construed as limitations on the scope of the disclosed technology or of what may be claimed, but rather as descriptions of features that may be specific to particular implementations of particular disclosed technologies. Certain features that are described in this specification in the context of separate implementations can also be implemented in combination in a single embodiment in part or in whole. Conversely, various features that are described in the context of a single embodiment can also be implemented in multiple implementations separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims.

The invention claimed is:

1. A helmet comprising:

an outer shell, the outer shell having an outer surface and an inner surface;

a first impact mitigation layer positioned at the inner surface of the outer shell, the first impact mitigation layer having a first stiffness;

a supplemental shell, at least a portion of the supplemental shell being coupled to the outer surface of the outer shell, the supplemental shell covering a portion of the outer surface of the outer shell and configured to flex on impact from a first position to a second position; and a second impact mitigation layer positioned between the outer surface of the outer shell and an inner surface of the supplemental shell, at least a portion of the supplemental shell enclosing at least a portion of the second impact mitigation layer between the outer surface of the outer shell and the inner surface of the supplemental shell, the second impact mitigation layer having a second stiffness that is different from the first stiffness, wherein the at least the portion of the supplemental shell and the at least the portion of the second impact mitigation layer are configured to locally deform in response to an impact on the supplemental shell.

2. The helmet of claim 1, wherein, upon the impact to the supplemental shell, the second impact mitigation layer is configured to provide a first impact absorption response and the first impact mitigation layer is configured to provide a second impact absorption response for a residual impact force remaining after the first impact absorption response.

3. The helmet of claim 1, wherein:

the second stiffness is less than the first stiffness; and the supplemental shell is coupled to a forehead portion of the outer shell.

4. The helmet of claim 3, wherein the second impact mitigation layer is configured to fully compress upon the impact of about 3 m/s to the supplemental shell.

5. The helmet of claim 3, wherein the first stiffness is about 20% stiffer than the second stiffness.

6. The helmet of claim 1, wherein the supplemental shell is formed from a first flexible material and the outer shell is formed from a second material, the second material comprising one of a rigid material or a second flexible material.

7. The helmet of claim 6, wherein the first flexible material of the supplemental shell is locally deformable.

8. The helmet of claim 1, wherein the second impact mitigation layer comprises a plurality of mitigation structures formed as one of flexible domed structures, flexible polygonal structures, flexible vertical structures, foam structures, undulating structures, laterally supported filament structures, auxetic structures, or 3D printed lattice structures.

9. The helmet of claim 8, wherein at least one edge of the supplemental shell is configured to be flush against the outer surface of the outer shell when the supplemental shell is coupled to the outer surface of the outer shell.

10. The helmet of claim 1, further comprising a bumper component coupled to a second portion of the supplemental shell, the bumper component configured to be fastened through the supplemental shell to the outer shell.

11. The helmet of claim 10, the bumper component further configured to couple to a facemask.

12. A helmet comprising:

an outer shell, the outer shell having an outer surface and an inner surface;

a first impact mitigation layer positioned at the inner surface of the outer shell, the first impact mitigation layer having a first stiffness;

a supplemental shell, at least a portion of the supplemental shell being coupled to the outer surface of the outer shell, the supplemental shell covering a portion of the outer surface of the outer shell and configured to flex on impact from a first position to a second position; and a second impact mitigation layer positioned between the outer surface of the outer shell and an inner surface of the supplemental shell, the second impact mitigation layer having a second stiffness that is different from the first stiffness, wherein the second impact mitigation layer comprises a plurality of impact mitigation structures coupled to the supplemental shell, wherein:

the supplemental shell is shaped and sized so as to fully enclose the plurality of impact mitigation structures when the supplemental shell is coupled flush to the outer surface of the helmet; and the supplemental shell and the plurality of impact mitigation structures are configured to locally deform in response to an impact on the supplemental shell.

13. The helmet of claim 12 wherein, upon the impact to the supplemental shell, the plurality of impact mitigation structures are configured to provide a first impact absorption response.

14. The helmet of claim 13, wherein a stiffness of the plurality of impact mitigation structures is tuned to a position-specific average impact speed.

15. The helmet of claim 14, wherein the plurality of impact mitigation structures are configured to fully compress upon the impact of about 3 m/s to the supplemental shell.

16. The helmet of claim 14, wherein the plurality of impact mitigation structures are configured to fully compress upon the impact of about 13-14 m/s to the supplemental shell.

17. The helmet of claim 1, wherein the at least the portion of the second impact mitigation layer is configured to elastically deform in response to the impact and return to its original configuration after impact.

18. The helmet of claim 17, wherein the at least the portion of the second impact mitigation layer comprises one or more impact mitigation structures configured to elastically deform in response to the impact and return to the original configuration after impact.

19. A football helmet comprising:

an outer shell;

a first impact mitigation layer positioned at an inner surface of the outer shell, the first impact mitigation layer having a first stiffness;

a second impact mitigation layer comprising one or more impact mitigation structures having a second stiffness that is different from the first stiffness;

a supplemental shell, at least a first portion of the supplemental shell being coupled to an outer surface of the outer shell, the supplemental shell covering a portion of the outer surface of the outer shell and configured to flex from a first position to a second position, wherein:

the one or more impact mitigation structures are positioned between the outer surface of the outer shell and an inner surface of the supplemental shell;

at least a second portion of the supplemental shell encloses at least the one or more impact mitigation structures between the outer surface of the outer shell and the inner surface of the supplemental shell; and the at least the second portion of the supplemental shell and the one or more impact mitigation structures are elastically deformable in response to an impact on the supplemental shell.

20. The football helmet of claim 19, wherein the second stiffness of the one or more impact mitigation structures is tuned to a position-specific average impact speed associated with a helmet wearer playing a particular position in football.

* * * * *